US011798772B2

(12) United States Patent
Wei

(10) Patent No.: US 11,798,772 B2
(45) Date of Patent: Oct. 24, 2023

(54) ON-CHIP MINIATURE X-RAY SOURCE AND MANUFACTURING METHOD THEREFOR

(71) Applicant: PEKING UNIVERSITY, Beijing (CN)

(72) Inventor: Xianlong Wei, Beijing (CN)

(73) Assignee: PEKING UNIVERSITY, Beijing (CN)

( * ) Notice: Subject to any disclaimer, the term of this patent is extended or adjusted under 35 U.S.C. 154(b) by 234 days.

(21) Appl. No.: 17/292,695

(22) PCT Filed: Nov. 7, 2019

(86) PCT No.: PCT/CN2019/116139
§ 371 (c)(1),
(2) Date: May 10, 2021

(87) PCT Pub. No.: WO2020/098556
PCT Pub. Date: May 22, 2020

(65) Prior Publication Data

US 2021/0398769 A1 Dec. 23, 2021

(30) Foreign Application Priority Data

Nov. 12, 2018 (CN) ..... 201811339577.X
Nov. 12, 2018 (CN) ..... 201821855698.5

(51) Int. Cl.
*H01J 35/02* (2006.01)
*H01J 35/14* (2006.01)
(Continued)

(52) U.S. Cl.
CPC ..... *H01J 35/025* (2013.01); *H01J 35/064* (2019.05); *H01J 35/16* (2013.01); *H01J 35/186* (2019.05);
(Continued)

(58) Field of Classification Search
CPC ..... H01J 35/16; H01J 35/025
See application file for complete search history.

(56) References Cited

U.S. PATENT DOCUMENTS 6,477,233 B1 * 11/2002 Ribbing ..... A61N 5/1001 378/129
6,683,415 B1 1/2004 Compain et al.
(Continued)

FOREIGN PATENT DOCUMENTS

CN 1561533 A 1/2005
CN 1767138 A 5/2006
(Continued)

OTHER PUBLICATIONS

First Office Action, Japanese Patent Application No. 2021-525676, dated Apr. 19, 2022, 12 pages.
(Continued)

*Primary Examiner* — Chih-Cheng Kao
(74) *Attorney, Agent, or Firm* — Fenwick & West LLP

(57) ABSTRACT

Provided are an on-chip miniature X-ray source and a method for manufacturing the same. The on-chip miniature X-ray source includes: an on-chip miniature electron source; a first insulating spacer provided on an electron-emitting side of the on-chip miniature electron source, where the first insulating spacer has a cavity structure; and an anode provided on the first insulating spacer, where a closed vacuum cavity is formed between the on-chip miniature electron source and the anode. The on-chip miniature X-ray source has the advantages of stable X-ray dose, low working requirements for vacuum, fast switch response, capability of integration and batch fabrication, and can be used in various types of small and portable X-ray detection, analysis and treatment devices.

15 Claims, 13 Drawing Sheets

(51) Int. Cl.

| | |
|---|---|
| ***H01J 9/18*** | (2006.01) |
| ***H01J 35/12*** | (2006.01) |
| ***H01J 35/16*** | (2006.01) |
| ***H01J 35/18*** | (2006.01) |
| ***H01J 35/06*** | (2006.01) |

(52) U.S. Cl.
CPC ..... *H01J 9/18* (2013.01); *H01J 35/12* (2013.01); *H01J 35/147* (2019.05); *H01J 2235/068* (2013.01)

(56) References Cited

U.S. PATENT DOCUMENTS

| | | | | |
|---|---|---|---|---|
| 2002/0085674 | A1* | 7/2002 | Price | H01J 35/00 378/143 |
| 2004/0150311 | A1 | 8/2004 | Jin | |
| 2004/0183430 | A1 | 9/2004 | Takenaka | |
| 2005/0123097 | A1* | 6/2005 | Wang | H01J 35/13 378/143 |
| 2005/0207537 | A1* | 9/2005 | Ukita | H01J 35/28 378/125 |
| 2006/0208339 | A1* | 9/2006 | Iioka | H01L 27/0688 257/532 |
| 2007/0189459 | A1 | 8/2007 | Eaton et al. | |
| 2007/0236150 | A1 | 10/2007 | Hayashida | |
| 2011/0255664 | A1* | 10/2011 | Ueda | H01J 35/16 378/119 |
| 2013/0129045 | A1* | 5/2013 | Ogura | H01J 35/12 378/140 |
| 2014/0177800 | A1* | 6/2014 | Sato | G01N 23/04 378/143 |
| 2015/0063540 | A1 | 3/2015 | Kim et al. | |
| 2019/0198279 | A1 | 6/2019 | Wei et al. | |

FOREIGN PATENT DOCUMENTS

| | | | | | |
|---|---|---|---|---|---|
| CN | 106298409 | A | | 1/2017 | |
| CN | 107248489 | A | * | 10/2017 | H01J 1/3042 |
| CN | 107248489 | A | | 10/2017 | |
| CN | 109273337 | A | | 1/2019 | |
| CN | 208923024 | U | | 5/2019 | |
| JP | H 03-261026 | A | | 11/1991 | |
| JP | 09283013 | A | * | 10/1997 | H01J 35/065 |
| JP | H 09-283013 | A | | 10/1997 | |
| JP | 2007-311195 | A | | 11/2007 | |
| JP | 2007311195 | A | * | 11/2007 | H01J 35/065 |
| JP | 2013-109902 | A | | 6/2013 | |
| JP | 2015-173045 | A | | 10/2015 | |
| TW | 200746214 | A | | 12/2007 | |

OTHER PUBLICATIONS

Partial Supplementary European Search Report, European Patent Office Application No. 19885758.3, dated Jul. 8, 2022, 11 pages.
PCT International Search Report and Written Opinion, International Application No. PCT/CN2019/116139, dated Jan. 23, 2020, 12 Pages.
China National Intellectual Property Administration, Office Action, CN Patent Application No. 201811339577.X, dated May 19, 2023, 24 pages.

* cited by examiner

ON-CHIP MINIATURE X-RAY SOURCE AND MANUFACTURING METHOD THEREFOR

This application is a 35 U.S.C 371 Patent Application of PCT Application No. PCT/CN2019/116139, filed on Nov. 7, 2019, and entitled "On-Chip Miniature X-Ray Source and Manufacturing Method Therefor" which claims the priorities to Chinese Patent Application No. 201811339577.X, titled "ON-CHIP MINIATURE X-RAY SOURCE AND MANUFACTURING METHOD THEREFOR", filed on Nov. 12, 2018 with the China National Intellectual Property Administration (CNIPA), and Chinese Patent Application No. 201821855698.5, titled "ON-CHIP MINIATURE X-RAY SOURCE", filed on Nov. 12, 2018 with the China National Intellectual Property Administration (CNIPA), each of which are incorporated herein by reference in their entireties.

FIELD

The present disclosure relates to the field of X-ray source, and in particular to an on-chip miniature X-ray source and a method for manufacturing the on-chip miniature X-ray source.

BACKGROUND

X-rays are widely used in health inspections, cancer radiotherapy, security check, industrial flaw detection, material analysis and other fields.

At present, an X-ray is generally generated by a hot cathode X-ray tube, and the hot cathode X-ray tube mainly includes a thermionic emission cathode and an anode. Electrons are accelerated after being emitted from the thermionic cathode, and such high-energy electrons bombard the anode, causing a bremsstrahlung radiation and an electron transition in atomic inner shell at the anode, and thereby producing an X-ray.

Since the thermionic emission cathode has the characteristics of large volume, high power consumption and long switching delay time, the hot cathode X-ray tube generally has a relatively large volume, high power consumption, and long switching response time. These problems limit the application of conventional thermionic emission X-ray tubes in many scenarios. On the other hand, demands for new X-ray instruments, such as light and small X-ray medical imaging systems, electronic brachytherapy equipment, portable X-ray detection and analysis devices, are increasing, and the key core component of these instruments is the miniature X-ray source. Therefore, the miniature X-ray source is an important electronic component which is increasingly demanded.

Researches on miniature X-ray sources began around 2000, and currently the small or miniature X-ray sources based on thermionic emission electron sources and based on nano-material field emission electron sources have been successfully developed.

The technology for the small X-ray source based on the thermionic emission electron source is relatively mature. The small X-ray source based on the thermionic emission electron source, though having a smaller and compact size, still has the problem of long switching response time, since it still uses the thermionic emission electron source and has a structure quite similar to conventional X-ray tubes. Therefore, it is difficult to apply the small X-ray source based on the thermionic emission electron source in scenarios such as dynamic X-ray imaging of a moving object.

Compared with the small X-ray source based on the thermionic emission electron source, the miniature X-ray source based on the nanomaterial (such as carbon nanotubes and zinc oxide nanowires) field emission electron source has a smaller size, lower power consumption, and shorter switching response time, and therefore is considered a very promising miniature X-ray source technology.

However, existing miniature X-ray sources all have problems such as difficulty in further reduction in size, high cost for batch production, and the like.

SUMMARY

In view of the above, an on-chip miniature X-ray source and a method for manufacturing the same are provided in the present disclosure, so as to further reduce the size and cost of the on-chip miniature X-ray source.

To solve the above technical problems, technical solutions proposed in the present disclosure are as follows.

An on-chip miniature X-ray source includes: an on-chip miniature electron source; a first insulating spacer provided on an electron-emitting side of the on-chip miniature electron source, where the first insulating spacer has a cavity structure; and an anode provided on the first insulating spacer, a closed vacuum cavity is formed between the on-chip miniature electron source and the anode.

In an embodiment, the on-chip miniature electron source includes: a substrate; a resistive-switching material film layer covering a surface of the substrate; and at least one electrode pair provided on the resistive-switching material film layer, where the electrode pair includes a first electrode and a second electrode, and there is a gap between the first electrode and the second electrode; in which, a tunnel junction is formed in a region of the resistive-switching material film layer under the gap.

In an embodiment, there are multiple electrode pairs, and the multiple electrode pairs are interdigital electrode pairs.

In an embodiment, the substrate is made of a material with good thermal conductivity, and the resistive-switching material film layer is provided with at least one through hole connecting with the substrate; at least one electrode of the electrode pair is in contact with and connected to the substrate via the through hole.

In an embodiment, the X-ray source further includes a first heat dissipation component provided on the anode.

In an embodiment, the X-ray source further includes a second heat dissipation component provided under the substrate.

In an embodiment, the first insulating spacer has a hollow cavity structure.

In an embodiment, the first insulating spacer has a cavity structure provided with a top cover, and a conductive plug is provided on the top cover; the anode is located under the top cover, and is electrically connected to an electrode on the first insulating spacer through the conductive plug.

In an embodiment, the X-ray source further includes: a hollow focusing electrode provided between the first insulating spacer and the on-chip miniature electron source, where a second insulating spacer is provided on a surface of the hollow focusing electrode close to the on-chip miniature electron source, and the second insulating spacer has a hollow cavity structure, where the second insulating spacer is attached to the on-chip miniature electron source.

In an embodiment, a suction component is provided in the closed vacuum cavity, the suction component is used to absorb gas in the closed vacuum cavity, to adjust or maintain a vacuum in the closed vacuum cavity.

In an embodiment, the anode includes a target layer and a support layer for supporting the target layer; the target layer is located on a side close to electron bombardment, and the support layer is located on a side far away from the electron bombardment.

In an embodiment, the target layer is made of heavy metal material, and the support layer is made of copper or aluminum.

In an embodiment, the anode has a thickness of 0.1 microns to 1000 microns.

A method for manufacturing an on-chip miniature X-ray source includes: preparing an on-chip miniature electron source; preparing the anode, where a first insulating spacer is provided on a surface of the anode, and the first insulating spacer has a cavity structure; and bonding the first insulating spacer to an electron-emitting side of the on-chip miniature electron source, so that a closed vacuum cavity is formed between the on-chip miniature electron source and the anode.

In an embodiment, before bonding the first insulating spacer to the on-chip miniature electron source, the method further includes: preparing a hollow focusing electrode, where a second insulating spacer is provided on a surface of the hollow focusing electrode, and the second insulating spacer has a hollow cavity structure; before bonding the first insulating spacer to the on-chip miniature electron source, the method further includes: bonding the second insulating spacer to the electron-emitting side of the on-chip miniature electron source; and the bonding the first insulating spacer to the on-chip miniature electron source includes: bonding the first insulating spacer to a side of the hollow focusing electrode away from the second insulating spacer.

In an embodiment, before attaching the first insulating spacer to an electron-emitting side of the on-chip miniature electron source, so that a closed vacuum cavity is formed between the on-chip miniature electron source and the anode, the method further includes: disposing a suction component into the closed vacuum cavity to be formed, where the suction component is used to absorb gas in the closed vacuum cavity, to adjust or maintain a vacuum in the closed vacuum cavity.

In an embodiment, the method further includes: forming a first heat dissipation component on the anode.

In an embodiment, the preparing an on-chip miniature electron source includes: providing a substrate; forming a resistive-switching material film layer that covers a surface of the substrate; and forming at least one electrode pair on the resistive-switching material film layer, where the electrode pair includes a first electrode and a second electrode, and there is a gap between the first electrode and the second electrode; before or after bonding the first insulating spacer to an electron-emitting side of the on-chip miniature electron source, so that a closed vacuum cavity is formed between the on-chip miniature electron source and the anode, the preparing an on-chip miniature electron source further includes: controlling the resistive-switching material film layer under the gap to be softly broken down and exhibit a resistive-switching characteristic, so as to form a tunnel junction in a region of the resistive-switching material film layer under the gap.

In an embodiment, the substrate has a good thermal conductivity, and after forming the resistive-switching material film layer and before forming the at least one electrode pair, the method further includes: forming, on the resistive-switching material film layer, at least one through hole connecting with the substrate, where at least one electrode of the electrode pair is in contact with and connected to the substrate via the through hole.

Compared with the conventional technology, the present disclosure has the following beneficial effects.

It can be seen from the above technical solutions that the on-chip miniature X-ray source provided in the present disclosure is based on an on-chip miniature electron source, which may be obtained through micro-fabrication process. Therefore, compared to the on-chip miniature X-ray source manufactured through traditional machining process in the conventional technology, the on-chip miniature X-ray source provided in the present disclosure may be obtain through micro-fabrication process, which may further reduce the size and manufacturing cost of the on-chip miniature X-ray source. Moreover, the on-chip miniature X-ray source has advantages of stable X-ray dose, low working requirements for vacuum, fast switch response, capability of integration and batch fabrication and so on, and can be applied to various small and portable X-ray detection, analysis and treatment equipment.

DETAILED DESCRIPTION

The existing miniature X-ray source is obtained by using traditional mechanical processing technology, and thus has some problems, for example, it is difficult to further reduce the size and has high cost for batch production. While the micro-fabrication technology is widely used in fabrication of large-scale integrated circuits, micro-electromechanical systems, micro-fluidic systems and other on-chip micro devices. The micro-fabrication technology is a mainstream fabrication technology for implement of the micro devices, and has advantages of small size of fabricated devices, low cost for batch fabrication and reliable fabrication techniques.

In order to solve the problems of the existing miniature X-ray source, an on-chip miniature X-ray source is provided in the present disclosure. The on-chip miniature X-ray source is based on an on-chip miniature electron source, which can be obtained through micro-fabrication process. Therefore, compared to the miniature X-ray source manufactured by traditional machining technology in the conventional technology, the on-chip miniature X-ray source provided in the present disclosure can be obtained through micro-fabrication technology, so as to further reduce the size and decrease manufacturing cost. Moreover, the on-chip miniature X-ray source has advantages of stable X-ray dose, low working requirements for vacuum, fast switch response, capability of integration and batch processing, and can be applied to various small and portable X-ray detection, analysis and treatment equipment.

To make the aforementioned objects, features and advantages of the present disclosure clearer, hereinafter implementations of the present disclosure will be described in detail in conjunction with the drawings.

First Embodiment

Figure 1A:
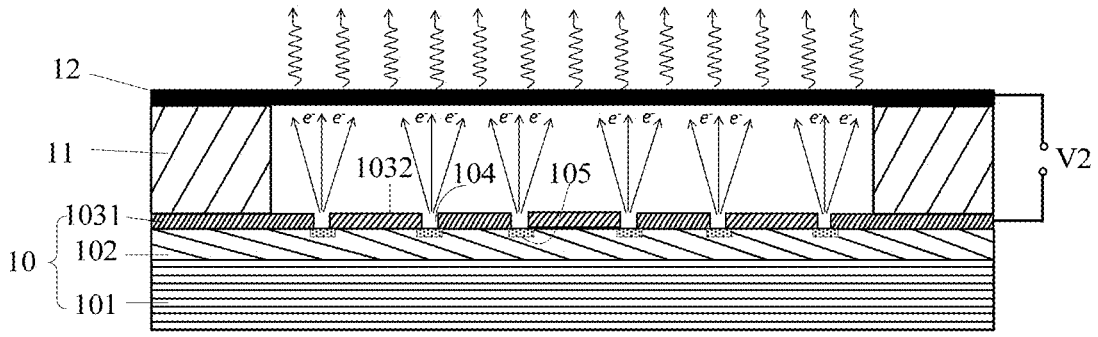
FIG. 1A is a schematic sectional view of a structure of an on-chip miniature X-ray source according to a first embodiment of the present disclosure.
Figure 1B:
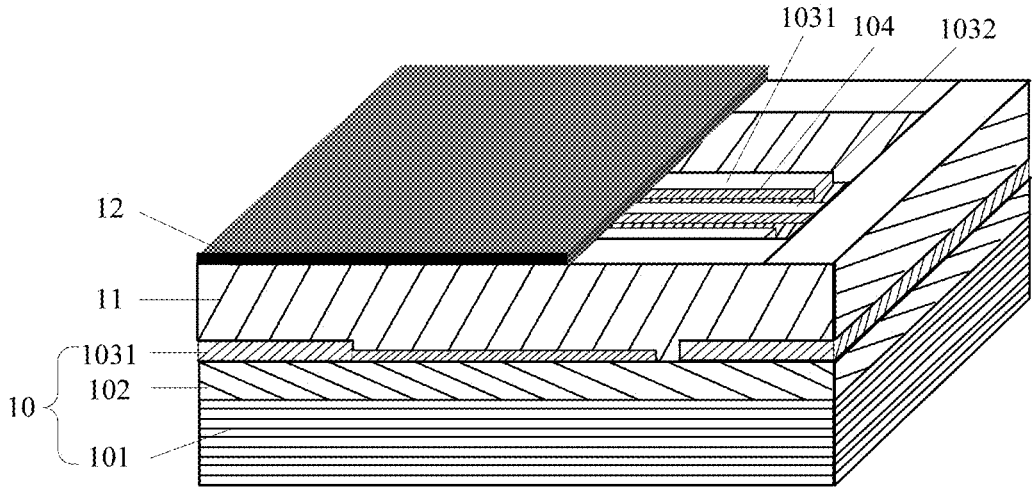
FIG. 1B is a schematic three-dimensional view of a structure of the on-chip miniature X-ray source according to the first embodiment of the present disclosure.
Figure 1C:
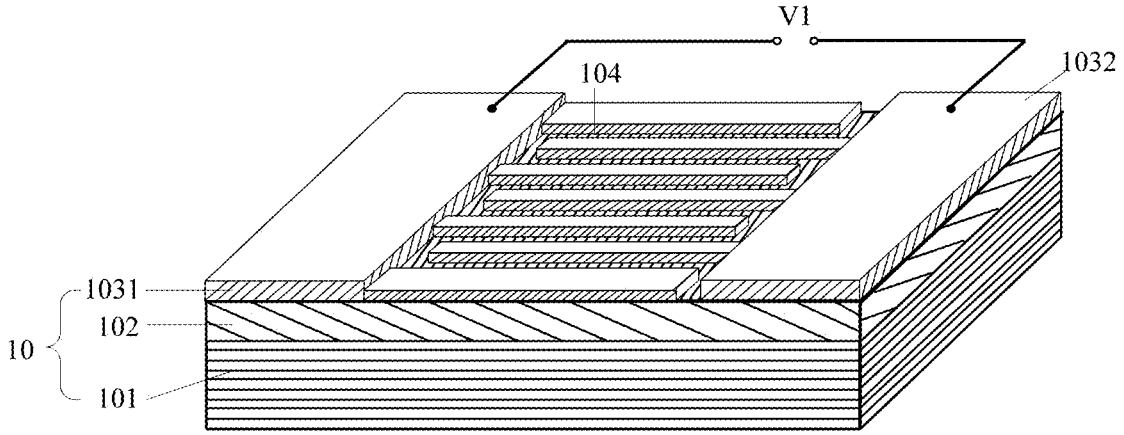
FIG. 1C is a schematic three-dimensional view of a structure of an on-chip miniature electron source in the on-chip miniature X-ray source according to the first embodiment of the present disclosure.

Reference is made to FIG. 1A to FIG. 1C, in which FIG. 1A is a schematic sectional view of a structure of an on-chip miniature X-ray source according to a first embodiment of the present disclosure, FIG. 1B is a schematic diagram of a three-dimensional structure of the on-chip miniature X-ray source according to the first embodiment of the present disclosure, and FIG. 1C is a schematic diagram of a three-dimensional structure of an on-chip miniature electron source in the on-chip miniature X-ray source according to the first embodiment of the present disclosure. It should be noted that, FIG. 1B is not a complete schematic diagram of the structure, and only part of an anode is drawn in order to show the internal structure.

According to the first embodiment of the present disclosure, the on-chip miniature X-ray source includes: an on-chip miniature electron source 10; a first insulating spacer 11 provided on an electron-emitting side of the on-chip miniature electron source 10, where the first insulating spacer 11 has a cavity structure; and an anode 12 provided on the first insulating spacer 11; where a closed vacuum cavity is formed between the on-chip miniature electron source 10 and the anode 12.

It should be noted that, as an example, the on-chip miniature electron source 10 may be a surface-tunneling electron source with a planar multi-region structure, so as to improve the emission efficiency of the on-chip miniature electron source 10. Specifically, the on-chip miniature electron source 10 may include: a substrate 101; a resistive-switching material film layer 102 covering a surface of the substrate 101; and multiple electrode pairs provided on the resistive-switching material film layer 102, where each of the electrode pairs includes a first electrode 1031 and a second electrode 1032, and for each electrode pair, there is a gap 104 between the first electrode 1031 and the second electrode 1032; a tunnel junction 105 is formed within a region of the resistive-switching material film layer 102 under the gap 104 (as shown in FIG. 1A).

The above resistive-switching material refers to that a material, which is initially electrically insulating, presents a resistive-switching state and has an ability to emit electrons after soft breakdown by voltage applied thereon, and transforms from an electrically insulating material into a conductive material after being activated.

Figure 2A:
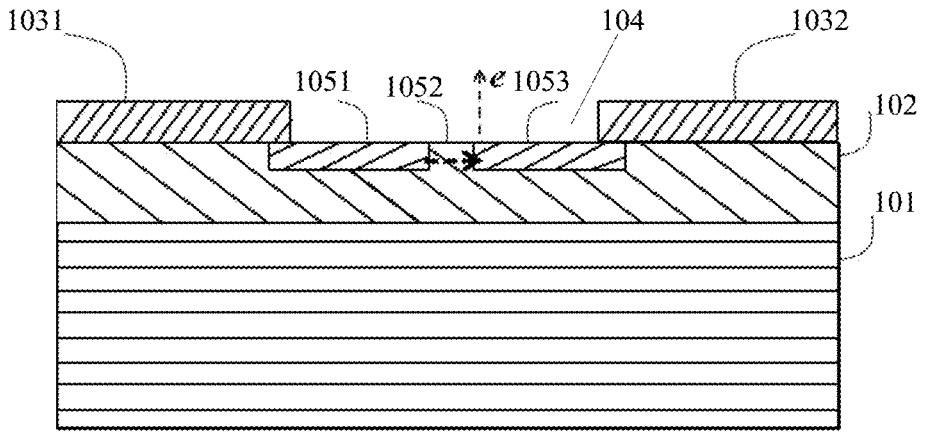
FIG. 2A is a schematic diagram of a structural principle of the on-chip miniature electron source according to the first embodiment of the present disclosure.

In order to clearly understand the working principle of the surface-tunneling electron source, FIG. 2A shows a structural diagram of the principle of the surface-tunneling electron source according to the embodiment of the present disclosure. As shown in FIG. 2A, a voltage is applied across the first electrode 1031 and the second electrode 1032, so that the resistive-switching material film layer 102 under the gap 104 is softly broken down. Therefore, the resistive-switching material film layer under the gap 104 transforms from an insulating state to a conductive state, and then undergoes a transition from a low-resistance state to a high-resistance state. After that, a conductive filament is broken and a tunnel junction 105 as shown in FIG. 2A is formed within the region of the resistive-switching material film layer 102 under the gap 104. The tunnel junction 105 is from the first electrode 1031 to the second electrode 1032, including a first conductive region 1051, an insulating region 1052, and a second conductive region 1053 that are connected in sequence.

Figure 2B:
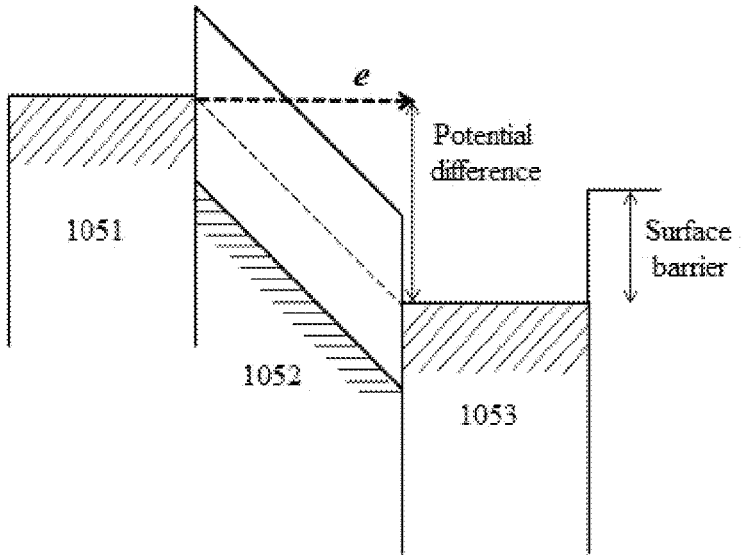
FIG. 2B is a schematic diagram of a band structure of a tunnel junction in the on-chip miniature electron source according to the first embodiment of the present disclosure.

A band diagram of the tunnel junction 105 formed within the region of the resistive-switching material film layer 102 under the gap 104 is shown in FIG. 2B. As such, as shown in FIG. 1C, when a voltage V1 is applied across the first electrode 1031 and the second electrode 1032, an electron tunnels from the first conductive region 1051 with a low potential to the insulating region 1052, and is accelerated in the insulating region 1052 to obtain energy over the vacuum energy level. The electron is emitted when reaching the second conductive region 1053 with a high potential.

It should be noted that, the substrate 101 may be Si substrate, Ge substrate, SiGe substrate, SOI (Silicon On Insulator), GOI (Germanium On Insulator) or the like.

In order to improve the heat dissipation capacity of the on-chip miniature electron source, the substrate 101 may be also made of a material with good thermal conductivity, or a material with both of good electrical conductivity and good thermal conductivity. In the case that the substrate 101 is made of a material with both of good electrical conductivity and good thermal conductivity, the substrate 101 may also serve as an electrode. In the embodiment of the present disclosure, a substrate 101 made of the material having both of good electrical conductivity and good thermal conductivity will be taken as an example for description.

As an example, the material used to make the substrate 101 with good electrical conductivity and good thermal conductivity may be a metal or a heavily doped semiconductor.

The resistive-switching material film layer 102 may include one or more materials selected from: silicon oxide, tantalum oxide, hafnium oxide, tungsten oxide, zinc oxide, magnesium oxide, zirconium oxide, titanium oxide, aluminum oxide, nickel oxide, germanium oxide, diamond and amorphous carbon. After being softly broken down, all of the above-mentioned materials may realize a transition from a low-resistance state to a high-resistance state and have an ability to emit electrons.

It should be noted that, in the embodiment of the present disclosure, multiple electrode pairs are formed on the resistive-switching material film layer 102 as an example. Actually, it may be also formed only one electrode pair.

The multiple electrode pairs formed on the resistive-switching material film layer 102 may have different structures. In the present embodiment, interdigital electrode pairs are taken as an example for description.

The first electrode 1031 and the second electrode 1032 may be made of any material for making an electrode. As an example, the first electrode 1031 and the second electrode 1032 may be made of one or more materials selected from metal, graphene, and carbon nanotube.

As an example, the gap 104 between the first electrode 1031 and the second electrode 1032 may have a width less than or equal to 10 μm. A relatively small width of the gap 104 is beneficial to controlling a formation of an insulating region 1052 with a small width in the tunnel junction 105, which ensures that significant electron tunneling and electron emission may occur and the insulating region 1052 will not be broken down when a voltage greater than the surface barrier of the conductive region is applied.

As an example, the first insulating spacer 11 has a hollow cavity structure, so that more electrons can bombard the anode 12 to generate X-rays, which improves the X-ray emission efficiency. Moreover, the first insulating spacer 11 may be made of a material with a better insulating property. As an example, the first insulating spacer 11 may be made of one or more materials selected from glass, quartz, ceramic, and plastic.

It should be noted that, the first insulating spacer 11 may have a thickness of 0.1 mm to 20 mm, in order to have a good insulation and isolation effect. The thickness of the first insulating spacer 11 may be increased as the voltage applied across both sides thereof increases, so as to achieve a better insulation effect.

As another example, the anode 12 may be made of a metal material. As a more specific example, the material for the anode may be one or more materials selected from tungsten, molybdenum, gold, silver, copper, chromium, rhodium, aluminum, niobium, tantalum, and rhenium. In addition, the anode 12 should not be too thick, so as to ensure that an X-ray can effectively penetrate the anode 12. As an example, the anode may have a thickness of 0.1 microns to 1000 microns.

The above is the structure of the on-chip miniature X-ray source provided in the embodiment of the present disclosure. The working principle of the on-chip miniature X-ray source is described as follows.

A voltage V1 is applied across the interdigital electrode pair to cause the on-chip miniature electron source 10 to emit electrons. Meanwhile, a voltage V2 is applied across the first electrode 1031 and the anode 12, so that the electrons emitted from the on-chip miniature electron source 10 are accelerated and bombard the anode 12 at a high speed. Due to a bremsstrahlung radiation and an energy level transition in atomic inner shell, an X-ray is generated inside the anode 12, and the X-ray penetrates the anode 12 and radiates to the outside space.

The above illustrates an implementation of the on-chip miniature X-ray source according to the embodiment of the present disclosure. In this specific implementation, the above-mentioned on-chip miniature X-ray source is based on the on-chip miniature electron source 10. The on-chip miniature electron source 10 may be obtained by micro-fabrication technology. Therefore, the X-ray source based on the on-chip miniature electron source 10 may also be obtained by micro-fabrication technology. In this way, the size of the on-chip miniature X-ray source according to the embodiment of the present disclosure may be further reduced, and the manufacturing cost thereof may also be decreased. Moreover, the on-chip miniature X-ray source has advantages of stable X-ray dose, low working requirements for vacuum, fast switch response, capability of integrity and batch fabrication, and can be applied to various small and portable X-ray detection, analysis and treatment equipment.

Figure 3:
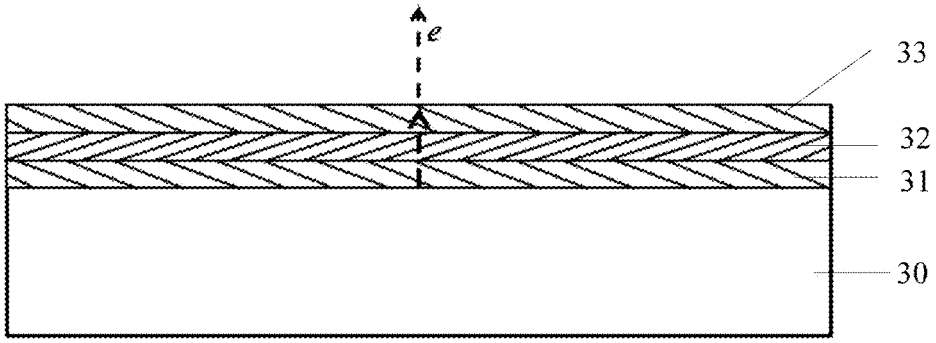
FIG. 3 is a schematic sectional view of a structure of a tunneling electron source having a vertical structure in the on-chip miniature X-ray source according to the first embodiment of the present disclosure.

It should be noted that, in the above embodiment, a surface tunneling electron source is taken as an example, to describe the on-chip miniature electron source 10. In practice, the on-chip miniature electron source 10 is not limited to the surface tunneling electron source, and may also be a tunneling electron source having a vertical structure. FIG. 3 shows a sectional structure of the tunneling electron source having a vertical structure. As shown in FIG. 3, the tunneling electron source having a vertical structure includes: a substrate 30; a first conductive layer 31 provided on the substrate 30; an insulating layer 32 provided on the first conductive layer 31; and a second conductive layer 33 provided on the insulating layer 32.

The working principle of the tunneling electron source having a vertical structure is described as follows. A positive bias is applied on the second conductive layer 33 relative to the first conductive layer 31, and a value of the bias is greater than a value of the surface barrier (in unit of electron volt) of the second conductive layer 33. Since the insulating layer 32 is very thin (comparable to the electron mean free path), electrons in the first conductive layer 31 pass through the insulating layer 32 and enter into the second conductive layer 33 due to the quantum tunneling effect. The energy of the electrons is increased to be greater than the vacuum energy level of the second conductive layer 33 in the process of tunneling through the insulating layer 32. Since the second conductive layer 33 is very thin, a part of the electrons tunneling through the insulating layer 32 may further pass through the second conductive layer 33 without being scattered, and may be emitted from the surface of the second conductive layer 33 into vacuum.

It should be noted that the tunneling electron source having a vertical structure may have a vertical structure based on metal-insulating layer-metal (M-I-M), or a vertical structure based on semiconductor-insulator-metal (S-I-M), or a vertical structure based on semiconductor-insulator-semiconductor (S-I-S).

In the on-chip miniature X-ray source shown in FIG. 1A to FIG. 1C, the first insulating spacer 11 is described by taking a hollow cavity structure as an example. In this way, more electrons can bombard the anode 12 to generate X-rays, so as to improve the X-rays emission efficiency.

Figure 4:
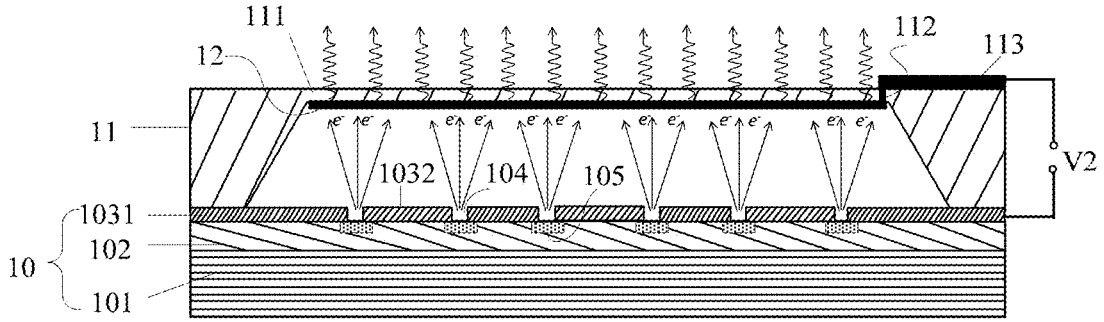
FIG. 4 is a schematic sectional view of a structure of another on-chip miniature X-ray source according to the first embodiment of the present disclosure.

Referring to FIG. 4, as an extension of the embodiment of the present disclosure, the first insulating spacer 11 may have a cavity structure provided with a top cover 111, and a conductive plug 112 is provided on the top cover 111. The anode 12 is located under the top cover 111. An electrical connection is formed between the conductive plug 112 and an electrode 113 on the first insulating spacer 11. The first insulating spacer 11 provided with the top cover 111 may improve the sealing performance of the closed vacuum cavity, which is beneficial to avoiding an interference of impurities in the environment to electron emission.

Based on the implementation of the on-chip miniature X-ray source provided in the first embodiment, a specific implementation of a method for manufacturing the on-chip miniature X-ray source is further provided according to the present disclosure.

Figure 5:
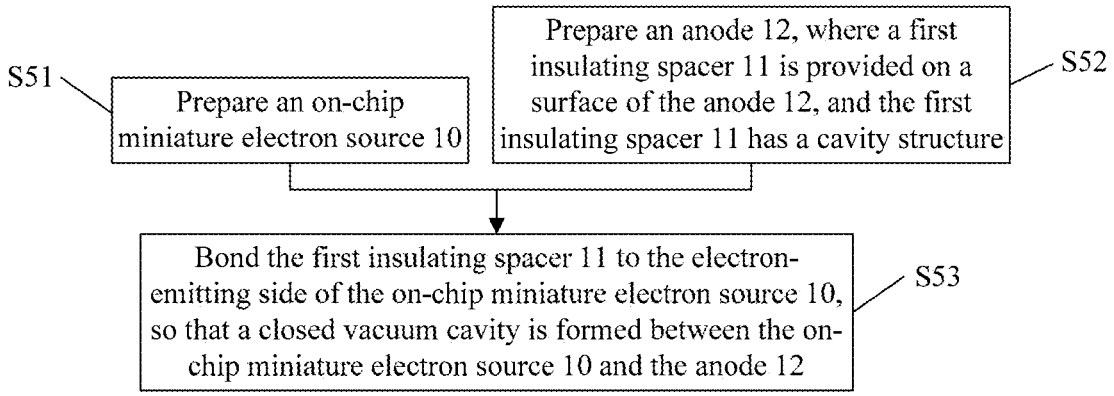
FIG. 5 is a schematic flowchart of a method for manufacturing the on-chip miniature X-ray source according to the first embodiment of the present disclosure.

Referring to FIG. 5, the method for manufacturing the on-chip miniature X-ray source provided in the first embodiment includes steps S51 to S53.

In step S51, an on-chip miniature electron source 10 is prepared.

Figure 6:
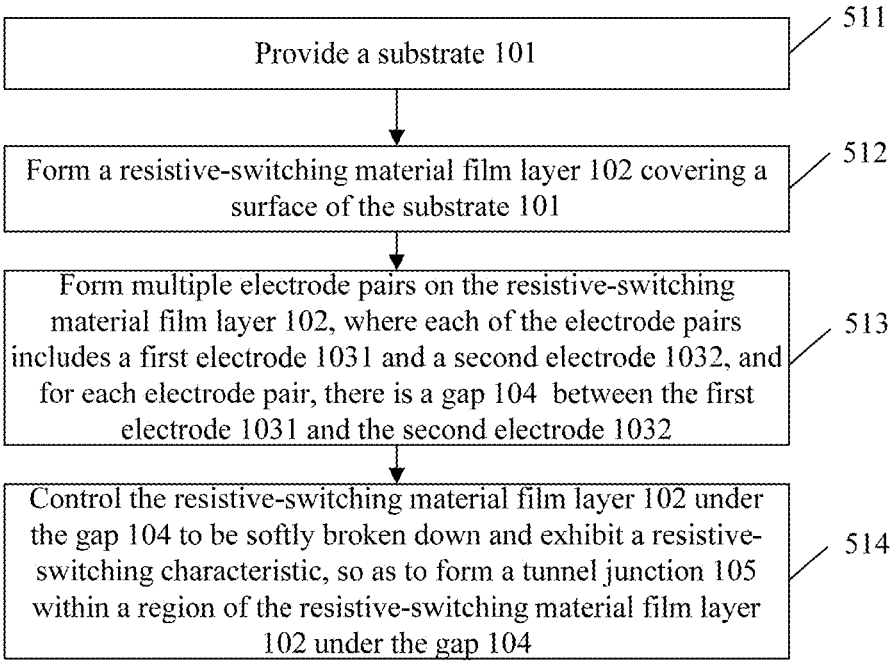
FIG. 6 is a schematic flowchart of a method for manufacturing the on-chip miniature electron source according to the first embodiment of the present disclosure.

As an example, an implementation of step S51 is described using an example in which the on-chip miniature electron source 10 is a surface tunneling electron source. Referring to FIG. 6, the preparation of the on-chip miniature electron source 10 may include following steps S511 to S514.

In step S511, a substrate 101 is provided.

Figure 7A:
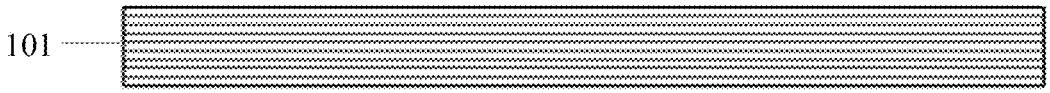
FIG. 7A to FIG. 7D are schematic sectional views of structures corresponding to a series of processes in the method for manufacturing the on-chip miniature electron source according to the first embodiment of the present disclosure.

A schematic sectional view of a structure obtained by step S511 is shown in FIG. 7A.

In step S512, a resistive-switching material film layer 102 covering a surface of the substrate 101 is formed.

Step S512 may specifically include: forming the resistive-switching material film layer 102 on the surface of the substrate 101 by using a thin film deposition process or a thermal oxidation process which are common used in the related field.

Figure 7B:
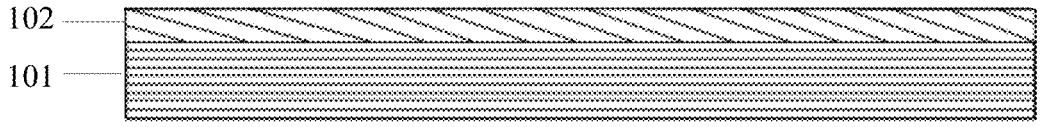

A schematic sectional view of a structure obtained by step S512 is shown in FIG. 7B.

In step S513, multiple electrode pairs are formed on the resistive-switching material film layer 102. Each of the electrode pairs includes a first electrode 1031 and a second electrode 1032, and for each electrode pair, there is a gap 104 between the first electrode 1031 and the second electrode 1032.

As an example, step S513 may include: depositing an electrode material layer on the resistive-switching material film layer 102 by using an electrode deposition process that is commonly used in the art. Specifically, the first electrode 1031 and the second electrode 1032 which cover a part of the resistive-switching material film layer 102, as well as the gap 104 between the first electrode 1031 and the second electrode 1032 are formed by processes of spin coating of electron beam resist, electron beam exposure, developing and fixing, metal thin film deposition, and lift-off process.

Figure 7C:
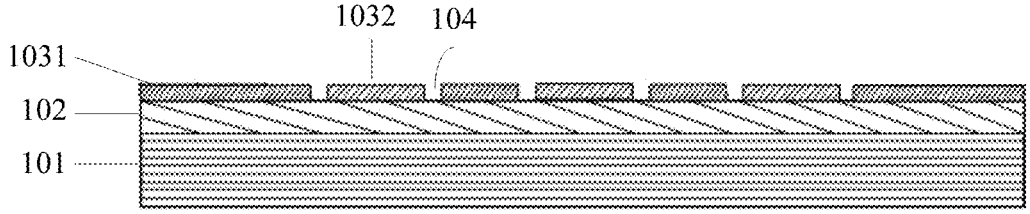

A schematic sectional view of a structure obtained by step S513 is shown in FIG. 7C.

In step S514, the resistive-switching material film layer 102 under the gap 104 is controlled to be softly broken down and exhibit a resistive-switching characteristic, so as to form a tunnel junction 105 within a region of the resistive-switching material film layer 102 under the gap 104.

Specifically, step S514 may be performed as follows. A voltage is applied across the first electrode 1031 and the second electrode 1032, and the value of the voltage is gradually increased. Meanwhile, the magnitude of a current is monitored, and a limit current is set as a certain current value, such as 100 μA. When the current increases suddenly and sharply, the increasing of the voltage is terminated. At this time, the resistive-switching material film layer 102 under the gap 104 is softly broken down and exhibits the resistive-switching characteristic. In this way, conductive filaments that traverse the entire resistive-switching material film layer 102 under the gap 104 are formed within the region of the resistive-switching material film layer 102, so that the region of the resistive-switching material film layer 102 transforms from an insulating state to a conductive state, and then undergoes a transition from a low-resistance state to a high-resistance state. After that, the conductive filaments are broken and a tunnel junction 105 as shown in FIG. 2A is formed within the region of the resistive-switching material film layer 102 under the gap 104. The tunnel junction 105 is from the first electrode 1031 to the second electrode 1032, including a first conductive region 1051, an insulating region 1052, and a second conductive region 1053 that are connected in sequence.

Figure 7D:
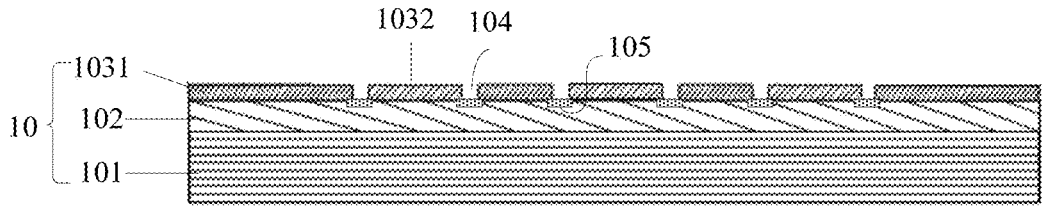

A schematic sectional view of a structure obtained by step S514 is shown in FIG. 7D.

Thus, the surface tunneling electron source as shown in FIG. 1A to FIG. 1C is formed. When the surface tunneling electron source works, electrons do not need to pass through multiple material layers during emission, thereby achieving a higher emission efficiency. Moreover, the surface tunneling electron source may be obtained through micro-fabrication technology, thereby achieving a relatively small size and a reduced manufacturing cost.

In step S52, an anode 12 is prepared. A first insulating spacer 11 is provided on a surface of the anode 12, and the first insulating spacer 11 has a cavity structure.

Specifically, step S52 may be performed as follows. An insulating layer with a thickness of 0.1 mm to 20 mm is selected, and a metal material layer is provided to cover a surface of the insulating layer by using a process of physical vapor deposition, chemical vapor deposition or spin coating that is commonly used in the art. The metal material layer is controlled to have a thickness of 0.1 mm to 1000 mm. The metal material layer serves as the anode 12. Then, the insulating layer is etched from a surface where the anode 12 is not provided by using a process of dry etching or wet etching, until the anode 12 is exposed. The insulating layer is etched into the first insulating spacer 11 having a hollow cavity structure.

Figure 8:
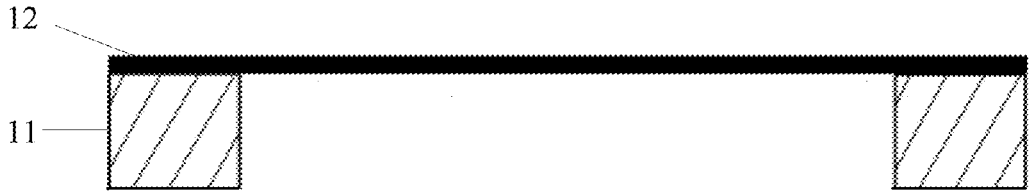
FIG. 8 is a schematic sectional view of a structure corresponding to a step of preparing an anode according to the first embodiment of the present disclosure.

A schematic sectional view of a structure obtained by step S52 is shown in FIG. 8.

In step S53, the first insulating spacer 11 is bonded to the electron-emitting side of the on-chip miniature electron source 10, so as to form a closed vacuum cavity between the on-chip miniature electron source 10 and the anode 12.

Specifically, step S53 may be performed as follows. In a vacuum, the first insulating spacer 11 is bonded to the electron-emitting side of the on-chip miniature electron source 10 through adhesion or bonding, so that the on-chip miniature electron source 10 and the anode 12 are attached tightly, and a closed vacuum cavity is formed.

A schematic view of a structure obtained by step S53 is shown in FIG. 1A.

It should be noted that, in the present disclosure, the sequence of steps S51 and S52 is not limited, and step S514 may be performed before or after step S53.

The above is a specific implementation of the method for manufacturing the on-chip miniature X-ray source provided in the first embodiment. The on-chip miniature X-ray source manufactured by this method has the same advantages as the on-chip miniature X-ray source shown in FIG. 1, which is not repeated herein for the sake of brevity.

The above illustrates an implementation of the on-chip miniature X-ray source and the method for manufacturing the same according to the first embodiment of the present disclosure. In order to improve the heat dissipation capacity of the on-chip miniature electron source in the on-chip miniature X-ray source, another implementation of an on-chip miniature X-ray source is further provided in the present disclosure. Reference is made to a second embodiment.

Second Embodiment

Figure 9A:
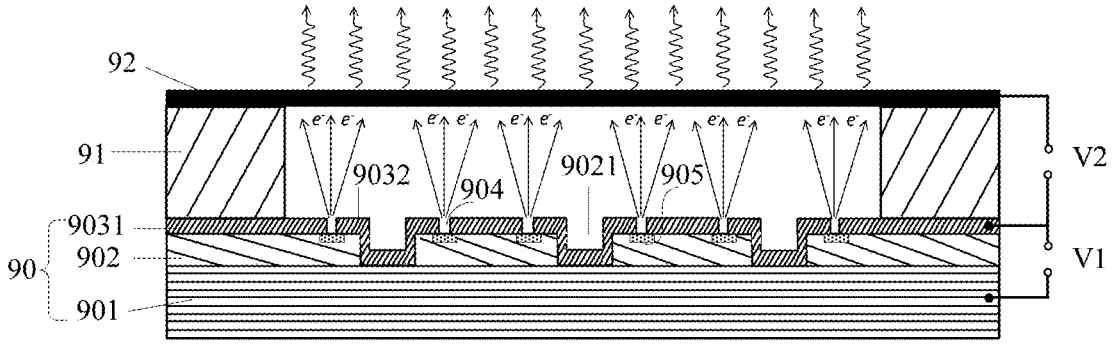
FIG. 9A is a schematic sectional view of a structure of an on-chip miniature X-ray source according to a second embodiment of the present disclosure.
Figure 9B:
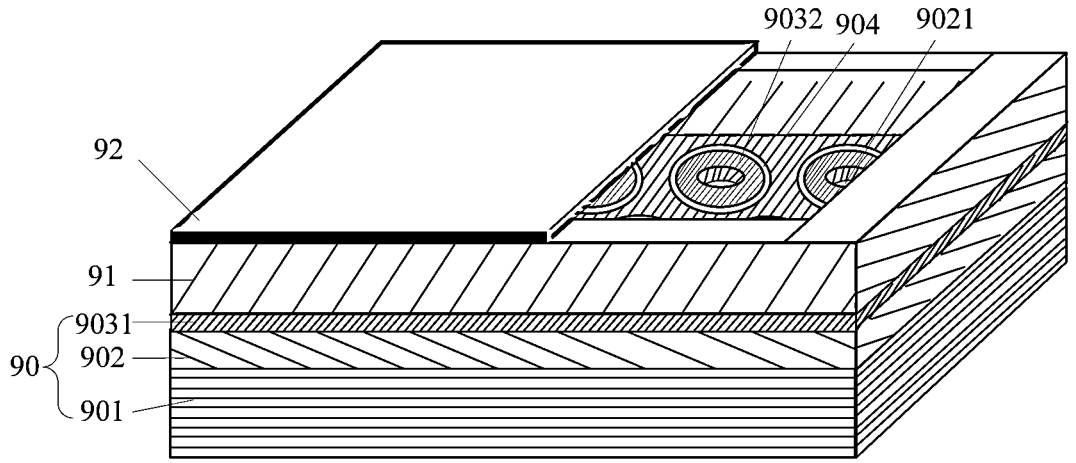
FIG. 9B is a schematic three-dimensional view of a structure of the on-chip miniature X-ray source according to the second embodiment of the present disclosure.

Referring to FIG. 9A to FIG. 9B, FIG. 9A is a schematic sectional view of a structure of an on-chip miniature X-ray source according to a second embodiment of the present disclosure, and FIG. 9B is a schematic three-dimensional view of the structure of the on-chip miniature X-ray source according to the second embodiment of the present disclosure. It should be noted that, FIG. 9B is not a schematic diagram of a complete structure, and only part of an anode is drawn in order to show the internal structure.

According to the second embodiment of the present disclosure, the on-chip miniature X-ray source includes: an on-chip miniature electron source 90; a first insulating spacer 91 provided on an electron-emitting side of the on-chip miniature electron source 90, where the first insulating spacer 91 has a cavity structure; and an anode 92 provided on the first insulating spacer 91; a closed vacuum cavity is formed between the on-chip miniature electron source 90 and the anode 92.

It should be noted that, the structure provided in the second embodiment is basically the same as that in the first embodiment, and the difference simply lies in the structure of the on-chip miniature electron source 90. Therefore, for the sake of brevity, the specific structures of the first insulating spacer 91 and the anode 92 will not be described in detail in this embodiment of the present disclosure, but only the on-chip miniature electron source 90 is described in detail.

Figure 9C:
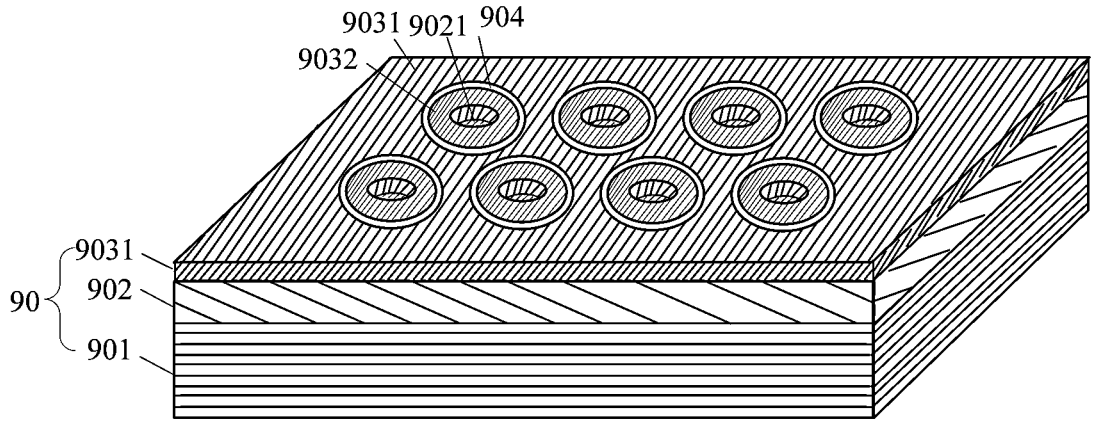
FIG. 9C is a schematic three-dimensional view of a structure of an on-chip miniature electron source in the on-chip miniature X-ray source according to the second embodiment of the present disclosure.

As an example, reference is made to FIG. 9A to FIG. 9C, and the on-chip miniature electron source 90 includes: a substrate 901; a resistive-switching material film layer 902 covering a surface of the substrate 901, where the resistive-switching material film layer 902 is provided with multiple through holes 9021 connecting with the substrate 901; and multiple electrode pairs provided on the resistive-switching material film layer 902, where each of the electrode pairs includes a first electrode 9031 and multiple second electrodes 9032, each of the second electrodes 9032 corresponds to a through hole among the through holes 9021 and each of the second electrodes 9032 is in contact with and connected to the substrate 901 via one of the through holes 9021, and the multiple second electrodes 9032 are isolated from each other; for each electrode pair, there is a gap 904 between the first electrode 9031 and each of the second electrodes 9032; a tunnel junction 905 is formed within a region of the resistive-switching material film layer 902 under each gap 904.

It should be noted that, materials used to make the substrate 901, the resistive-switching material film layer 902, the first electrode 9031 and the second electrodes 9032 are the same as that for the substrate 101, the resistive-switching material film layer 102, the first electrode 1031 and the second electrode 1032 provided in the first embodiment, and will not be repeated herein for the sake of brevity.

In the present embodiment, the tunnel junction 905 formed within the region of the resistive-switching material film layer 902 under each gap 904 has the same structure as the tunnel junction 105 in the first embodiment, and are not repeated herein for the sake of brevity.

It should be noted that, the through holes 9021 may be set with different shapes. As an example, multiple circular through holes 9021 which are isolated from each other may be provided on the resistive-switching material film layer 902.

In the present embodiment, for the convenience of manufacturing, the first electrode 9031 may be a continuous electrode layer covering on the resistive-switching material film layer 902, each of the second electrodes 9032 may be an electrode island covering an inner wall of the circular through hole 9021, and the electrode island is electrically isolated from the first electrode 9031.

Since the through hole 9021 has a circular shape, correspondingly, the gap 904 between the first electrode 9031 and each of the second electrodes 9032 may be a circular gap 904. Since there are multiple second electrodes 9032, an electrode pair array including multiple electrode pairs may be formed between the first electrode 9031 and the second electrodes 9032, and accordingly, multiple gaps 904 form a gap array.

It should be noted that, in the present embodiment, each gap 904 may have a width less than or equal to 10 μm.

Each electrode among the multiple second electrodes 9032 is connected to the substrate 901 via the circular through hole 9021. In this way, heat generated during operation of the on-chip miniature electron source may be dissipated through the second electrodes 9032 and the substrate 901, thereby significantly improving the heat dissipation capability of the on-chip miniature electron source 90, which facilitates an integration of multiple on-chip miniature electron sources on a same substrate 901.

It should be noted that, when the on-chip miniature electron source 90 provided in the present embodiment is working, a voltage may be applied across the first electrode 9031 and each of the second electrodes 9032, so that electrons may be emitted from each tunnel junction 905, thereby forming a larger emission current.

In addition, when the substrate 901 is made of a material layer with both of good thermal conductivity and electrical conductivity, since each of the second electrodes 9032 is in contact with and connected to the substrate 901, a voltage V1 may be applied across the first electrode 9031 and the substrate 901 in order to simplify the process of applying voltage, as another example of the present disclosure. Since each of the second electrodes 9032 is in contact with and connected to the substrate 901, an electrical signal applied on the substrate 901 may be transmitted to each of the second electrodes 9032, which avoids the process of applying a voltage over each of the second electrodes 9032.

The above illustrates the structure of the on-chip miniature electron source 90 in the on-chip miniature X-ray source according to the second embodiment of the present disclosure. The on-chip miniature X-ray source based on the on-chip miniature electron source 90 has a same working principle as the on-chip miniature X-ray source provided in FIG. 1A and FIG. 1B according to the first embodiment, which will not be repeated herein for the sake of brevity.

The above is another implementation of the on-chip miniature X-ray source provided in the second embodiment of the present disclosure. In this implementation, a material with both thermal conductivity and electrical conductivity is selected to make the substrate 901 of the on-chip miniature electron source 90. Each of the second electrodes 9032 is connected to the substrate 901 via multiple through holes 9021 in the resistive-switching material film layer 902. In this way, the heat generated by the on-chip miniature electron source 90 may be dissipated through the second electrodes 9032 and the substrate 901, thereby significantly improving the heat dissipation capability of the on-chip miniature electron source 90, which facilitates the integration of multiple on-chip miniature electron sources on a same substrate 901. Furthermore, the on-chip miniature X-ray source based on the on-chip miniature electron source 90 may obtain more emitted electrons for bombarding the anode 92, thereby increasing the emission dose of the X-ray source.

It should be noted that, in the foregoing embodiment, the first electrode 9031 of each electrode pair serves as a common electrode. In other words, the first electrode 9031 may serve as a first electrode of all the electrode pairs. In fact, as another embodiment of the present disclosure, the first electrodes of all the electrode pairs may be independent from each other.

In the second embodiment, the heat dissipation of the on-chip miniature electron source is accelerated by the connection between the second electrodes 9032 of each electrode pair and the substrate 901 via through holes 9021. In fact, when the substrate 901 is made of an insulating material, the first electrode 9031 and the second electrodes 9032 may be in contact with and connected to the substrate 901 via different through holes 9021 respectively, so as to achieve a further improvement of the heat dissipation capability of the on-chip miniature electron source.

Based on the above implementation of the on-chip miniature X-ray source provided in the second embodiment, a specific implementation of the method for manufacturing the on-chip miniature X-ray source is further provided according to the present disclosure.

Figure 10:
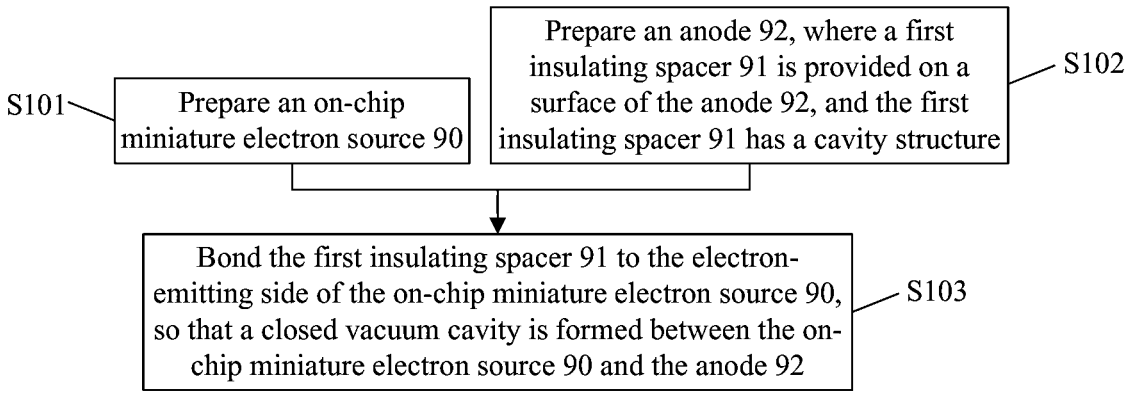
FIG. 10 is a schematic flowchart of a method for manufacturing the on-chip miniature X-ray source according to the second embodiment of the present disclosure.

Referring to FIG. 10, the method for manufacturing the on-chip miniature X-ray source provided in the second embodiment includes steps S101 to S103.

In step S101, an on-chip miniature electron source 90 is prepared.

The on-chip miniature electron source 90 may be a surface tunneling electron source same as that provided in FIG. 9C.

Figure 11:
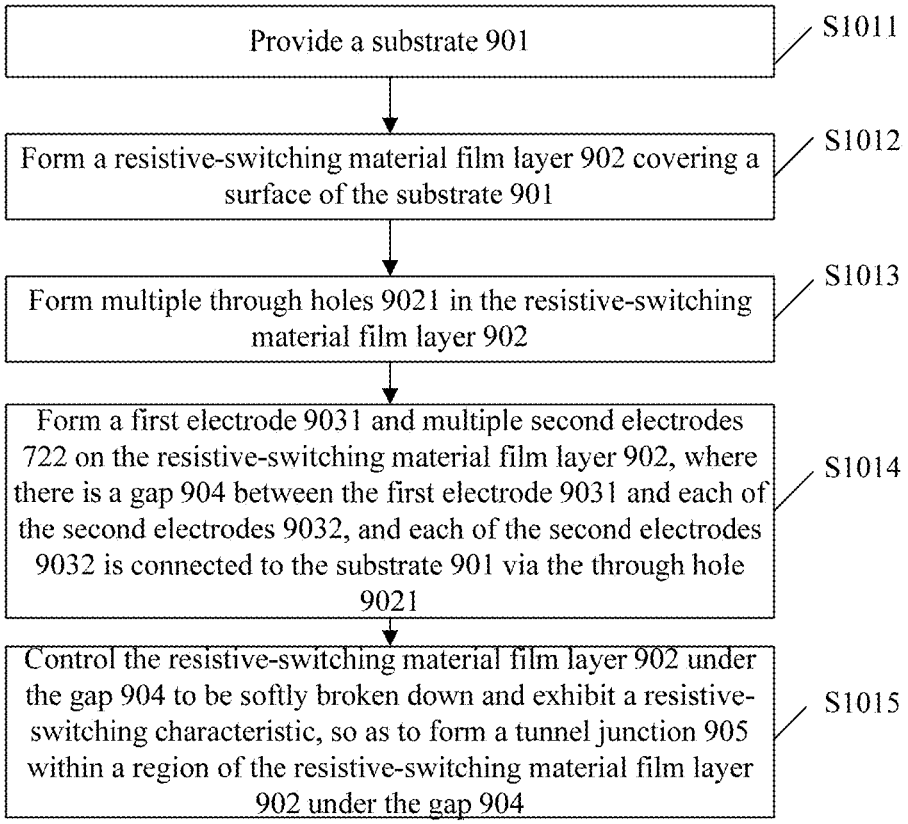
FIG. 11 is a schematic flowchart of a method for manufacturing the on-chip miniature electron source according to the second embodiment of the present disclosure.

Referring to FIG. 11, the preparation of the on-chip miniature electron source 90 may include the following steps S1011 to S1015.

In step S1011, a substrate 901 is provided.

The substrate 901 may be made of a material that is the same as the material for the substrate 901 of the on-chip miniature electron source in FIG. 9C, which is not repeated herein for the sake of brevity.

Figure 12A:
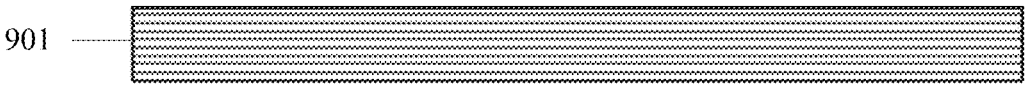
FIG. 12A to FIG. 12E are schematic sectional views of structures corresponding to a series of processes in the method for manufacturing the on-chip miniature electron source according to the second embodiment of the present disclosure.

A schematic sectional view of a structure obtained by step S1011 is shown in FIG. 12A.

In step S1012, a resistive-switching material film layer 902 covering a surface of the substrate 901 is formed.

An implementation of step S1012 may be the same as that of step S512 in the first embodiment, and will not be described in detail herein for the sake of brevity.

Figure 12B:
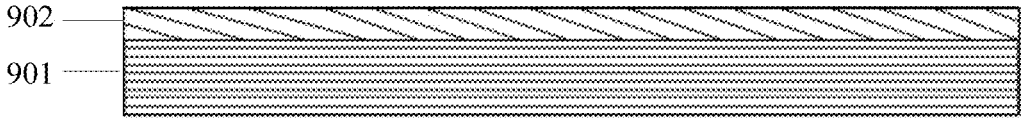

A schematic sectional view of a structure obtained by step S1012 is shown in FIG. 12B.

In step S1013, multiple through holes 9021 are formed in the resistive-switching material film layer 902.

The through holes 9021 may be formed using a process of dry etching or wet etching. As an example, the dry etching may be reactive gas etching, plasma etching, or the like.

When forming the through holes 9021 in the resistive-switching material film layer 902 by using the wet etching, this step may specifically include: spin-coating electron beam resist on the resistive-switching material film layer 902, and forming multiple circular through holes 9021 on the resistive-switching material film layer 902 by processes of electron beam exposure, developing and fixing, wet etching and lift-off process.

Figure 12C:
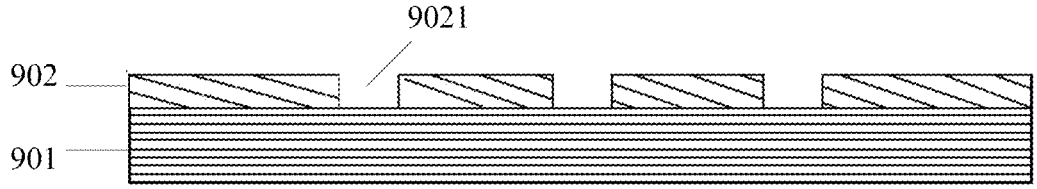

A schematic sectional view of a structure obtained by step S1013 is shown in FIG. 12C.

In step S1014, a first electrode 9031 and multiple second electrodes 9032 are formed on the resistive-switching material film layer 902. There is a gap 904 between the first electrode 9031 and each of the second electrodes 9032, and each of the second electrodes 9032 is connected to the substrate 901 via the through hole 9021.

As an example, this step may include: depositing an electrode material layer on the resistive-switching material film layer 902 and an inner wall of the through hole 9021 by using an electrode deposition technology which is commonly used. Specifically, the first electrode 9031 and the second electrodes 9032 are formed by processes of spin coating of electron beam resist, electron beam exposure, developing and fixing, metal thin film deposition, and lift-off process. The first electrode 9031 may be an electrode layer covering on the resistive-switching material film layer 902, and each of the second electrodes 9032 may be an electrode layer covering one through hole 9021 and the resistive-switching material film layer 902 around the through hole 9021.

In addition, among the multiple second electrodes 9032 formed on the resistive-switching material film layer 902, each of the second electrodes is connected to the substrate 901 via a circular through hole 9021. In this way, the heat dissipation capability of the on-chip miniature electron source is significantly improved, which facilitates an integration of multiple on-chip miniature electron sources on a same substrate 901.

Figure 12D:
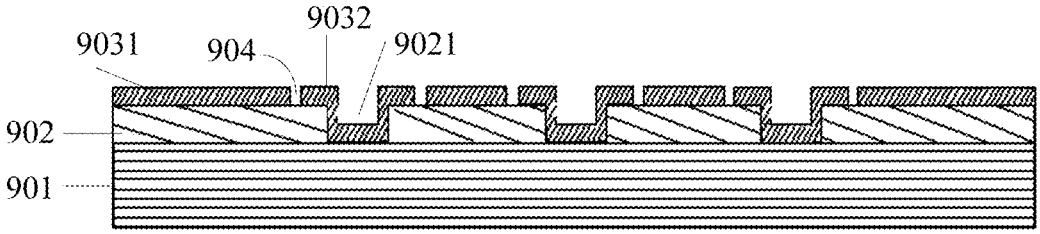

A schematic sectional view of a structure obtained by step S1014 is shown in FIG. 12D.

In step S1015, the resistive-switching material film layer 902 under the gap 904 is controlled to be softly broken down and exhibit a resistive-switching characteristic, so as to form a tunnel junction 905 within a region of the resistive-switching material film layer 902 under the gap 904.

An implementation of step S1015 may be the same as that of step S514 in the first embodiment, and will not be described in detail herein for the sake of brevity.

Figure 12E:
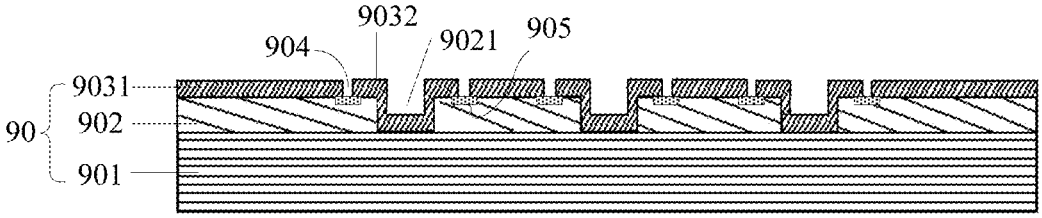

A schematic sectional view of a structure obtained by step S1015 is shown in FIG. 12E.

Thus, a surface tunneling electron source is formed. The surface tunneling electron source has the same beneficial effects as the surface tunneling electron source provided in FIG. 9C, which will not be repeated herein for the sake of brevity.

Steps S102 to S103 are the same as steps S52 to S53, and are not described in detail herein for the sake of brevity. A schematic sectional view of a structure obtained by step S102 is shown in FIG. 8, and a schematic sectional view of a structure obtained by step S103 is shown in FIG. 9.

It should be noted that, the sequence of steps S101 and S102 is not limited in the present disclosure, and step S1015 may be performed before or after step S103, which is not limited in the present disclosure.

The above is another specific implementation of the method for manufacturing the on-chip miniature X-ray source provided in the second embodiment. The on-chip miniature X-ray source manufactured by this method has the same advantages as the on-chip miniature X-ray source provided in FIG. 9A and FIG. 9B, which is not repeated herein for the sake of brevity.

The above illustrates an implementation of the on-chip miniature X-ray source and the method for manufacturing the same according to the second embodiment of the present disclosure. In order to further improve the heat dissipation capability of the entire on-chip miniature X-ray source, a heat dissipation component may be formed on the anode 92 and the substrate 901. In view of this, another implementation of the on-chip miniature X-ray source is further provided in the present disclosure, and reference may be made to a third embodiment.

Third Embodiment

It should be noted that the on-chip miniature X-ray source provided in the third embodiment of the present disclosure may be obtained by making improvements on above-mentioned first or second embodiment. As an example, the third embodiment is obtained by making improvements on the second embodiment.

Figure 13:
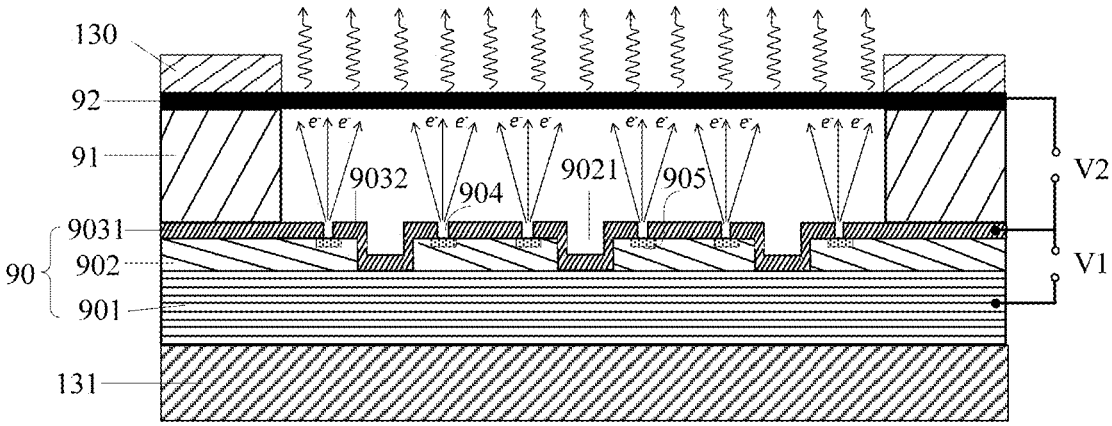
FIG. 13 is a schematic sectional view of a structure of an on-chip miniature X-ray source according to a third embodiment of the present disclosure.

Referring to FIG. 13, in addition to all the components in the second embodiment, an on-chip miniature X-ray source may further include: a first heat dissipation component 130 provided on the anode 92; and a second heat dissipation component 131 provided under the substrate 901.

It should be noted that the first heat dissipation component 130 or the second heat dissipation component 131 may be a heat sink or heat dissipation fin with good heat dissipation capability.

In addition, the first heat dissipation component 130 and the anode 92 are closely attached to and in good thermal contact with each other, and the same applies to the second heat dissipation component 131 and the substrate 901. In this way, when the on-chip miniature X-ray source is working, the heat generated on the anode 92 may be quickly dissipated through the first heat dissipation component 130, and the heat generated on the on-chip miniature electron source 90 may be efficiently dissipated through the second electrodes 9032, the resistive-switching material film layer 902 and the second heat dissipation component 131 sequentially.

The above is an implementation of the on-chip miniature X-ray source provided in the third embodiment of the present disclosure. Based on the on-chip miniature X-ray source according to the second embodiment, in this implementation, the on-chip miniature X-ray source is further provided with heat dissipation components on the anode 92 and under the substrate 901 respectively, so that the on-chip miniature X-ray source has a significantly improved heat dissipation capacity of the entire on-chip miniature X-ray source, in addition to the same beneficial effects as the on-chip miniature X-ray source provided in the second embodiment.

Based on the implementation of the on-chip miniature X-ray source provided in the third embodiment, an implementation of the method for manufacturing the on-chip miniature X-ray source is further provided in the present disclosure.

Figure 14:
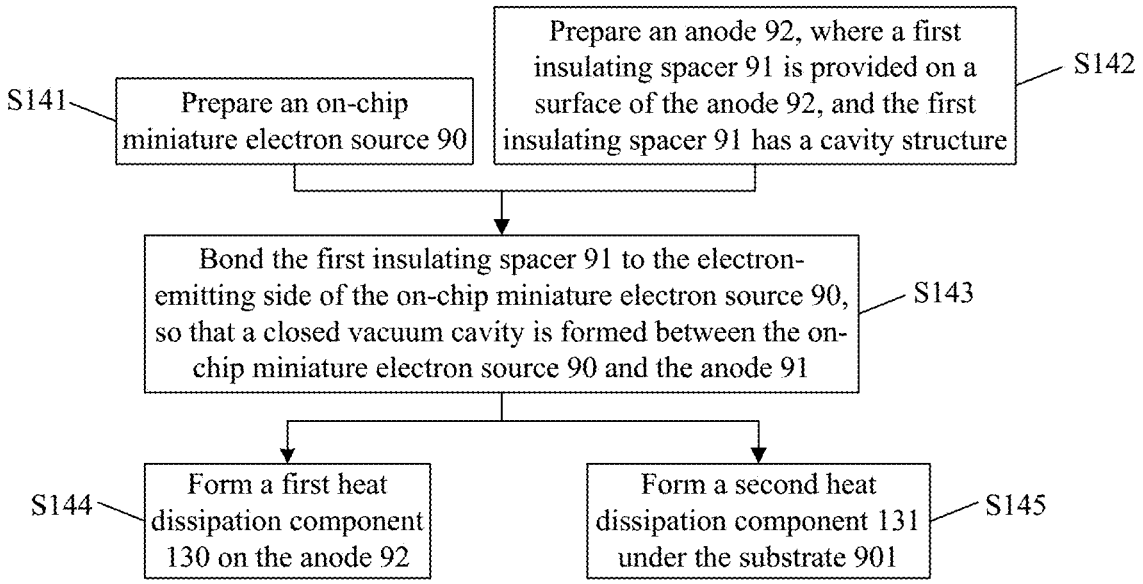
FIG. 14 is a schematic flowchart of a method for manufacturing the on-chip miniature X-ray source according to the third embodiment of the present disclosure.

Referring to FIG. 14, the method for manufacturing the on-chip miniature X-ray source provided in the third embodiment includes steps S141 to S145.

Steps S141 to S143 are the same as steps S101 to S103, and are not described in detail herein for the sake of brevity. A schematic sectional view of a structure obtained by step S143 is shown in FIG. 9A.

In step S144, a first heat dissipation component 130 is formed on the anode 92.

The first heat dissipation component 130 and the anode 92 may be closely attached to and in good thermal contact with each other by means of adhesion or bonding.

As an example, in order to achieve better thermal contact between the first heat dissipation component 130 and the anode 92, step S144 may specifically include: attaching the first heat dissipation component 130 and the anode 92 through a thermally conductive adhesive layer, so that the first heat dissipation component 130 and anode 92 are in close attached to and in good thermal contact with each other.

Figure 15:
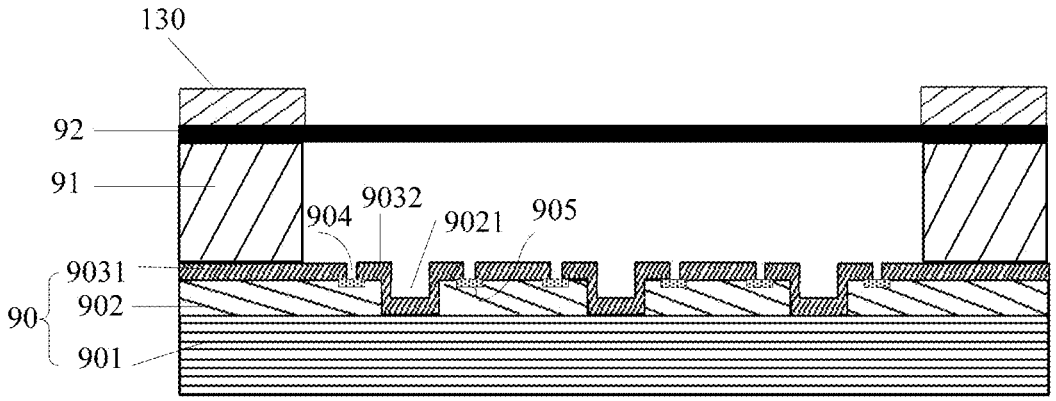
FIG. 15 is a schematic sectional view of a structure corresponding to a step of preparing a first heat dissipating component according to the third embodiment of the present disclosure.

A schematic sectional view of a structure obtained by step S144 is shown in FIG. 15.

In step S145, a second heat dissipation component 131 is formed under the substrate 901.

The second heat dissipation component 131 and the substrate 901 may be attached in the same manner as step S144, which is not described in detail herein for the sake of brevity.

A schematic sectional view of a structure obtained by step S145 is shown in FIG. 13.

It should be noted that, in the present disclosure, the sequence of steps S141 and S142 is not limited, and the sequence of steps S144 and S145 is also not limited.

The above is a specific implementation of the method for manufacturing the on-chip miniature X-ray source provided in the third embodiment. The on-chip miniature X-ray source manufactured by this method has the same advantages as the on-chip miniature X-ray source in FIG. 13, which is not repeated herein for the sake of brevity.

The above illustrates an implementation of the on-chip miniature X-ray source and the method for manufacturing the same according to the third embodiment of the present disclosure. In order to improve a tested quality of the on-chip miniature X-ray source, a hollow focusing electrode and a second insulating spacer may be formed between the first insulating spacer 91 and the on-chip miniature electron source 90. Based on this, another implementation of the on-chip miniature X-ray source is further provided in the present disclosure, and reference may be made to a fourth embodiment.

Fourth Embodiment

It should be noted that the on-chip miniature X-ray source provided in the fourth embodiment may be obtained by making improvements on the above-mentioned on-chip miniature X-ray source provided by any of the first, second and third embodiments. As an example, the fourth embodiment is obtained by making improvements on the basis of the second embodiment.

Figure 16:
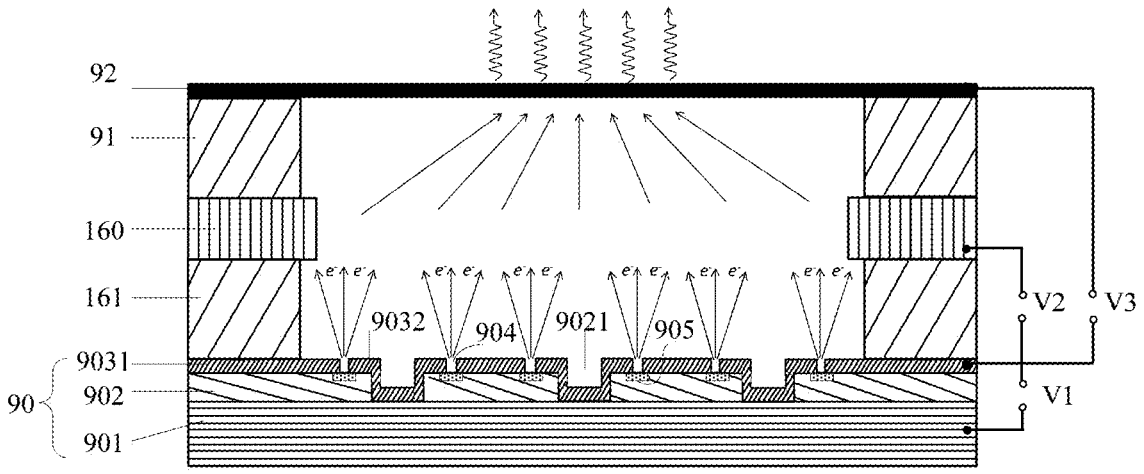
FIG. 16 is a schematic sectional view of a structure of an on-chip miniature X-ray source according to a fourth embodiment of the present disclosure.

Referring to FIG. 16, in addition to all the components in the second embodiment, an on-chip miniature X-ray source may further include: a hollow focusing electrode 160, provided between the first insulating spacer 91 and the on-chip miniature electron source 90; and a second insulating spacer 161, provided on a surface of the hollow focusing electrode 160 close to the on-chip miniature electron source 90, where the second insulating spacer 161 has a hollow cavity structure.

It should be noted that the hollow focusing electrode 160 may be made of a material with good electrical conductivity, such as a metal material.

In addition, in order to enhance the ability to focus the emitted electrons, the hollow focusing electrode 160 between the first insulating spacer 91 and the on-chip miniature electron source 90 may be a single layer or multiple layers.

In addition, the material and thickness of the second insulating spacer 161 may be the same as those of the first insulating spacer 91, which are not described in detail herein for the sake of brevity.

The above is the structure of the on-chip miniature X-ray source provided according to the embodiment of the present disclosure. The working principle of the on-chip miniature X-ray source is described as follows.

A voltage V1 is applied across the first electrode 9031 and the substrate 901, to cause the on-chip miniature electron source 90 to emit electrons. Meanwhile, a voltage V2 is applied across the first electrode 9031 and the anode 92, so that the electrons emitted from the surface tunneling electron source are accelerated and bombard the anode 92 at a high speed. Due to a bremsstrahlung radiation and an energy level transition in atomic inner shell, an X-ray is generated inside the anode 12, and the X-ray penetrates the anode 12 and radiates to the outside space. A voltage V3 is applied across the first electrode 9031 and the hollow focusing electrode 160 to focus the electrons emitted by the on-chip electron source 90, thereby reducing the area on the anode 92 being bombarded by the electron beam and the size of a focal spot of the X-ray, which facilitates to improve the tested quality of the on-chip X-ray source.

Based on the implementation of the on-chip miniature X-ray source provided in the fourth embodiment, an implementation of the method for manufacturing the on-chip miniature X-ray source is further provided in the present disclosure.

Figure 17:
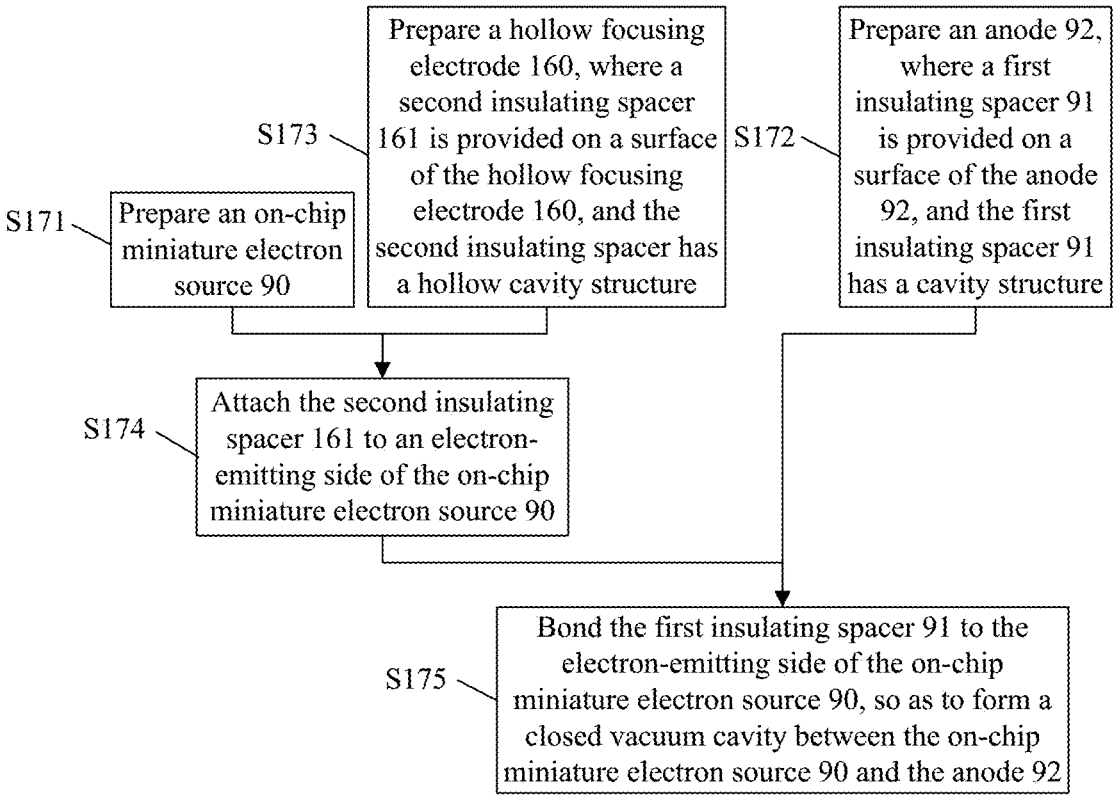
FIG. 17 is a schematic flowchart of a method for manufacturing the on-chip miniature X-ray source according to the fourth embodiment of the present disclosure.

Referring to FIG. 17, the method for manufacturing the on-chip miniature X-ray source provided in the fourth embodiment includes steps S171 to S175.

Steps S171 to S172 are the same as steps S101 to S102, and are not described in detail herein for the sake of brevity.

A schematic sectional view of a structure obtained by step S171 is shown in FIG. 9C, and a schematic sectional view of a structure obtained by step S172 is shown in FIG. 8.

In step S173, a hollow focusing electrode 160 is prepared, where a second insulating spacer 161 is provided on a surface of the hollow focusing electrode 160, and the second insulating spacer has a hollow cavity structure.

Specifically, step S173 may be performed as follows. An insulating layer with a thickness of 0.1 mm to 20 mm is selected, and a focusing electrode layer is formed on a surface of the insulating layer by using a process of physical vapor deposition, chemical vapor deposition or spin coating that is commonly used in the art. Then, the insulating layer is etched from a surface where the focusing electrode layer is not provided by using a process of dry etching or wet etching, until the focusing electrode layer is exposed, thereby forming the hollow focusing electrode 160 and the insulating spacer 161 with a hollow structure.

Figure 18A:
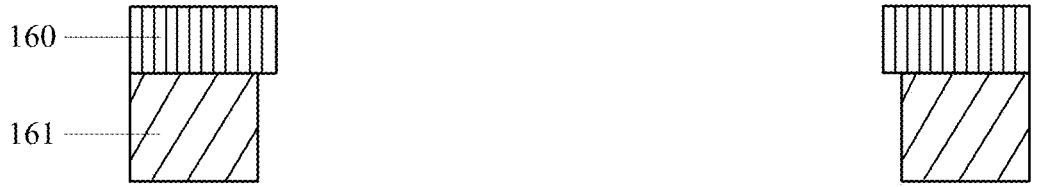
FIG. 18A to FIG. 18B are schematic sectional views of structures corresponding to a series of processes in the method for manufacturing the on-chip miniature X-ray source according to the fourth embodiment of the present disclosure.

A schematic sectional view of a structure obtained by step S173 is shown in FIG. 18A.

In step S174, the second insulating spacer 161 is attached to an electron-emitting side of the on-chip miniature electron source 90.

An implementation of step S174 may be the same as that of step S53 in the first embodiment, and is not repeated herein for the sake of brevity.

Figure 18B:
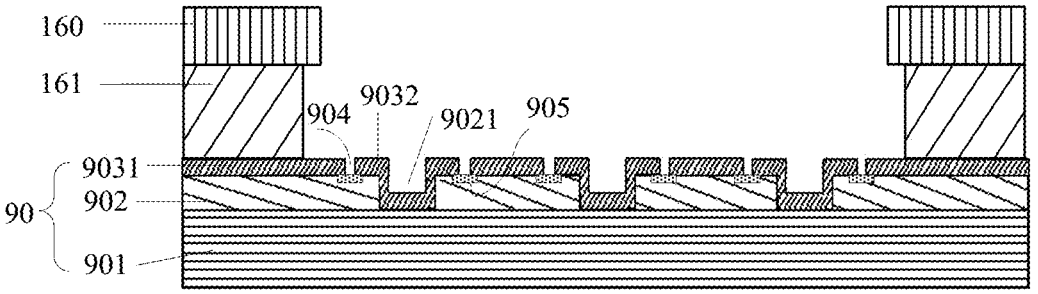

A schematic sectional view of a structure obtained by step S174 is shown in FIG. 18B.

In step S175, the first insulating spacer 91 is attached to the electron-emitting side of the on-chip miniature electron source 90, so as to form a closed vacuum cavity between the on-chip miniature electron source 90 and the anode 92.

Specifically, step S175 may be performed as follows. The first insulating spacer 91 is attached to a side of the hollow focusing electrode 160 away from the second insulating spacer 161 through adhesion or bonding, so that the first insulating spacer 91 and the hollow focusing electrode 160 are tightly attached, and a closed vacuum cavity is formed.

A schematic view of a structure obtained by step S175 is shown in FIG. 16.

It should be noted that, in the present disclosure, the sequence of steps S171, S172 and S173 is not limited.

The above is a specific implementation of the method for manufacturing the on-chip miniature X-ray source provided in the fourth embodiment. The on-chip miniature X-ray source manufactured by this method has the same advantages as the on-chip miniature X-ray source in FIG. 16, which is not repeated herein for the sake of brevity.

The fourth embodiment illustrates an implementation of an on-chip miniature X-ray source. In order to improve the performance of the on-chip miniature X-ray source, the anode may be improved and a suction component may be disposed in the vacuum cavity. Based on this, another implementation of the method for manufacturing the on-chip miniature X-ray source is further provided in the present disclosure, and reference may be made to a fifth embodiment.

Fifth Embodiment

It should be noted that the on-chip miniature X-ray source provided in the fifth embodiment may be obtained by making improvements on the above-mentioned on-chip miniature X-ray source according to any of the first to fourth embodiments. As an example, the fifth embodiment is obtained by making improvements on the basis of the fourth embodiment.

In addition, the on-chip miniature X-ray source has the same components as the on-chip miniature X-ray source provided in the fourth embodiment. For the sake of brevity, only the improved components are described hereinafter.

Figure 19:
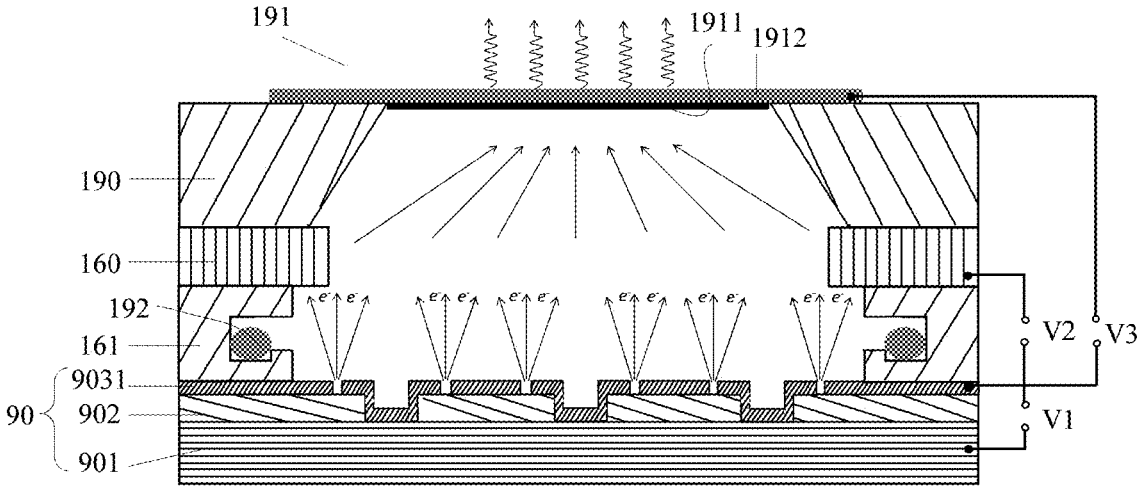
FIG. 19 is a schematic sectional view of a structure of an on-chip miniature X-ray source according to a fifth embodiment of the present disclosure.

Referring to FIG. 19, an on-chip miniature X-ray source may further include: a first insulating spacer 190 provided on an electron-emitting side of the on-chip miniature electron source 90, where the first insulating spacer 190 has a cavity structure; an anode 191 provided on the first insulating spacer 190, where the anode 191 includes a target layer 1911 and a support layer 1912 for supporting the target layer 1911, the target layer 1911 is located on a side close to electron bombardment, and the support layer 1912 is located on a side far away from the electron bombardment; and a suction component 192 provided in the closed vacuum cavity.

It should be noted that the material and thickness of the first insulating spacer 190 may be the same as those of the first insulating spacer 91 shown in FIG. 16 in the fourth embodiment, which will not be described herein for the sake of brevity.

In addition, the target layer 1911 may be made of a heavy metal material. As an example, the heavy metal material may be at least one material selected from tungsten, molybdenum, gold, silver, copper, chromium, rhodium, aluminum, niobium, tantalum, and rhenium. The support layer 1912 may be made of a material with good thermal conductivity, as an example, the material of the support layer 1912 may be aluminum or copper. In this way, the anode 191 including the target layer 1911 and the support layer 1912 may have effectively improved mechanical strength and thermal conductivity.

In addition, the on-chip miniature X-ray source in the present embodiment is provided with a hollow focusing electrode 160, which may reduce the area of the anode 191 bombarded by electrons and therefore reduce the area of the target layer 1911 in the anode 191.

In order to absorb gas in the closed vacuum cavity to adjust or maintain the vacuum in the closed vacuum cavity, a reliable getter may be selected as the suction component 192. As an example, the suction component 192 may include one or more getters selected from zirconium-graphite getter, zirconium-zirconium-iron-vanadium getter, and molybdenum-titanium getter.

It should be noted that, the second insulating spacer 161 may be provided with a groove for disposing the suction component 192, so as to placing the suction component 192 in the closed vacuum cavity.

Figure 20:
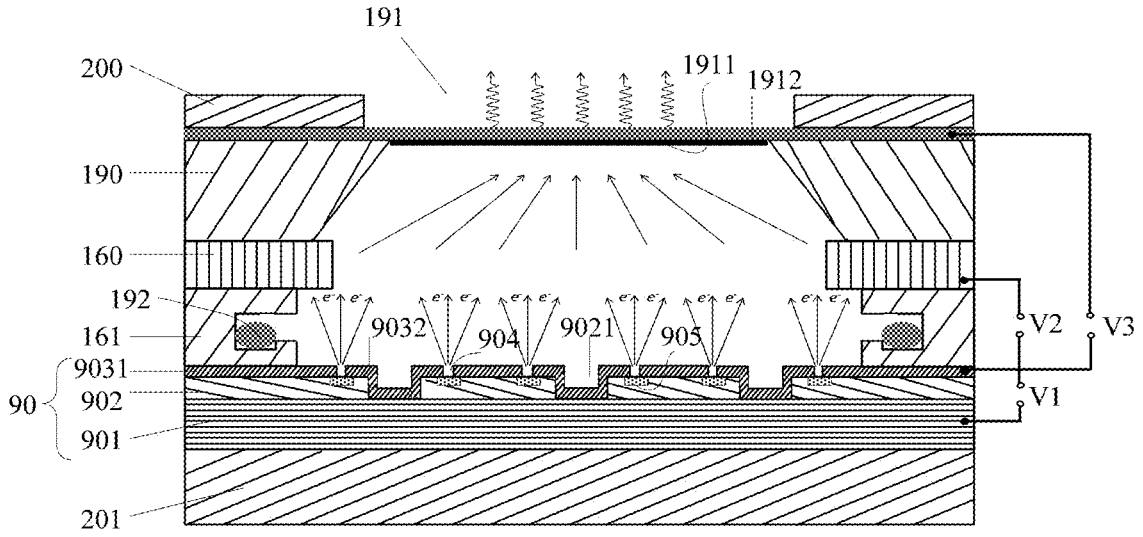
FIG. 20 is a schematic sectional view of a structure of another on-chip miniature X-ray source according to the fifth embodiment of the present disclosure.

In order to improve the heat dissipation capability of the entire on-chip miniature X-ray source, as another example, improvements may be made on the on-chip miniature X-ray source provided in FIG. 19 in the embodiment of the present disclosure. Referring to FIG. 20, a first heat dissipation component 200 may be formed on the anode 191, and a second heat dissipation component 201 may be formed under the substrate 901.

It should be noted that the first heat dissipation component 200 and the second heat dissipation component 201 may be a heat sink or a heat dissipation fin with good heat dissipation capability.

The above illustrates an implementation of the on-chip miniature X-ray source provided in the fifth embodiment of the present disclosure. In this implementation, the anode 191 in the on-chip miniature X-ray source includes the target layer 1911 and the support layer 1912, and the closed vacuum cavity is further provided with the suction component 192. Therefore, the mechanical strength and thermal conductivity of the anode 191 are effectively improved, and the vacuum in the closed vacuum cavity can be adjusted or maintained, which significantly improves the performance of the on-chip miniature X-ray source.

Based on the implementation of the on-chip miniature X-ray source provided in the fifth embodiment, an implementation of the method for manufacturing the on-chip miniature X-ray source is further provided in the present disclosure.

Figure 21:
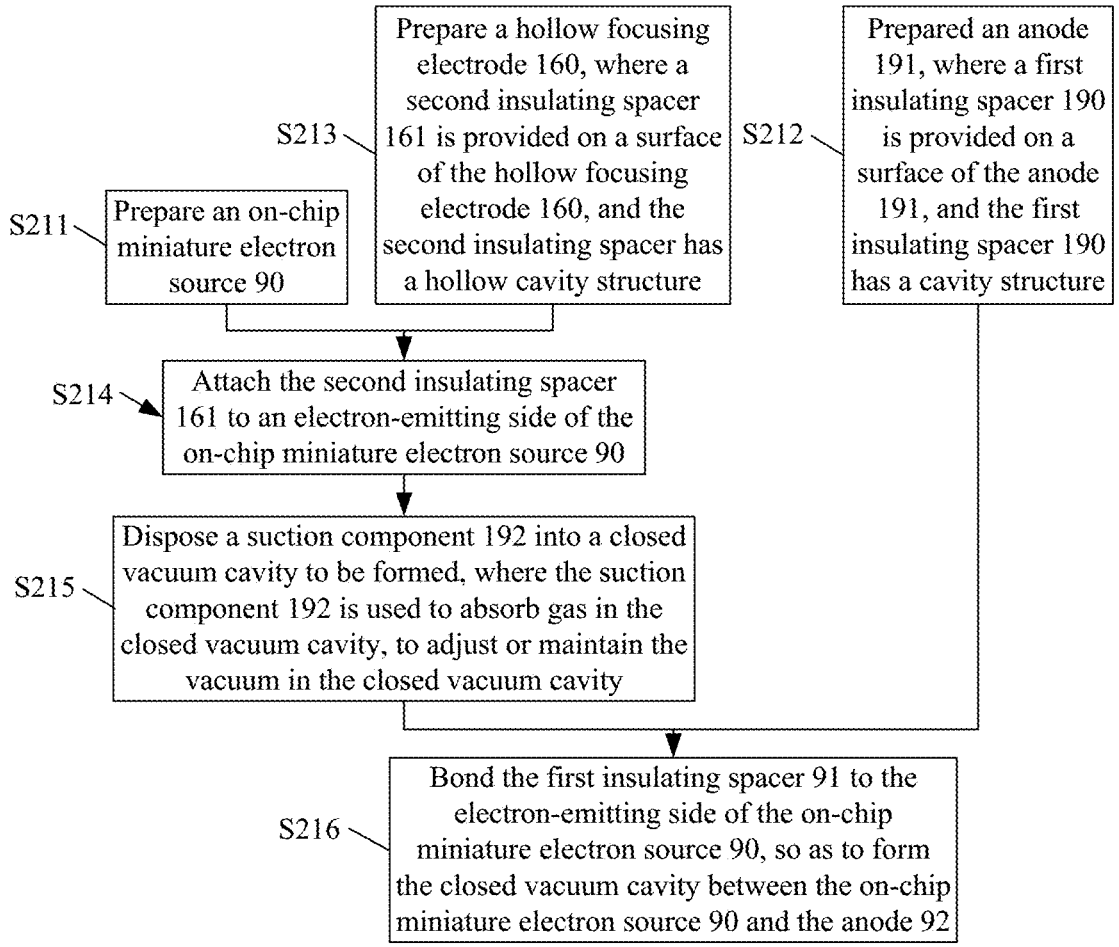
FIG. 21 is a schematic flowchart of a method for manufacturing the on-chip miniature X-ray source according to the fifth embodiment of the present disclosure.

Referring to FIG. 21, the method for manufacturing the on-chip miniature X-ray source provided in the fifth embodiment includes steps S211 to S216.

Step S211 is the same as step S171, and is not described in detail herein for the sake of brevity. A schematic sectional view of a structure obtained by step S211 is shown in FIG. 12E.

In step S212, an anode 191 is prepared. A first insulating spacer 190 is provided on a surface of the anode 191, and the first insulating spacer 190 has a cavity structure.

It should be noted that the anode 191 includes a target layer 1911 and a support layer 1912 for supporting the target layer 1911.

Specifically, step S212 may be performed as follows. An insulating spacer with a thickness of 0.1 mm to 20 mm is selected, and a heavy metal material layer is provided to cover a center region of a surface of the insulating spacer by using a process of physical vapor deposition, chemical vapor deposition or spin coating that is commonly used in the art. The heavy metal material layer serves as the target layer 1911. Then, a thermal conductive material layer is deposited on the target layer 1911 through a process of physical vapor deposition, chemical vapor deposition or spin coating, and the thermal conductive material layer covers the target layer 1911 and the insulating spacer. The thermal conductive material layer serves as the support layer 1912. Finally, etching is started from a surface of the insulating spacer opposite to the surface covering the anode 191 and is ended to the target layer 1911, through a process of dry etching or wet etching. The insulating spacer is etched into a hollow structured cavity that gradually shrinks from top to bottom, so that the surface of the target layer 1911 opposite to the insulating spacer is completely exposed, and the first insulating spacer 190 is formed.

Figure 22A:
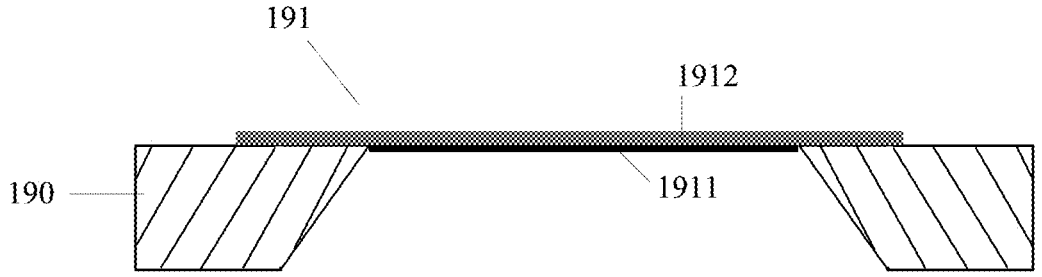
FIG. 22A to FIG. 22B are schematic sectional views of structures corresponding to a series of processes in the method for manufacturing the on-chip miniature X-ray source according to the fifth embodiment of the present disclosure.

A schematic sectional view of a structure obtained by step S212 is shown in FIG. 22A.

Steps S213 to S214 are the same as steps S173 to S174, and are not described in detail herein for the sake of brevity. A schematic sectional view of a structure obtained by step S213 is shown in FIG. 18A, and a schematic sectional view of a structure obtained by step S214 is shown in FIG. 18B.

In step S215, a suction component 192 is disposed into a closed vacuum cavity to be formed. The suction component 192 is used to absorb gas in the closed vacuum cavity, to adjust or maintain the vacuum in the closed vacuum cavity.

Specifically, step S215 may be performed as follows. At least one groove is formed by etching a side wall of the second insulating spacer 161 through a process of dry etching, and the suction component 192 is disposed in the groove.

Figure 22B:
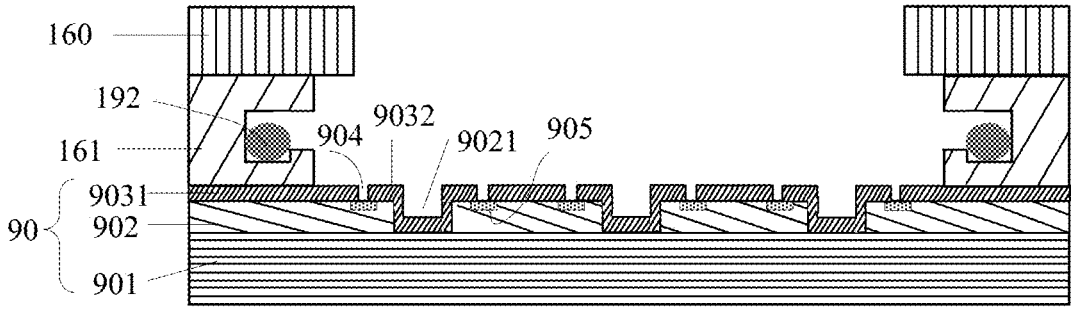

A schematic sectional view of a structure obtained by step S215 is shown in FIG. 22B.

Step S216 is the same as step S175, and is not described in detail herein for the sake of brevity. A schematic sectional view of a structure obtained by step S216 is shown in FIG. 19.

The above is a specific implementation of the method for manufacturing the on-chip miniature X-ray source provided in the fifth embodiment. The on-chip miniature X-ray source manufactured by this method has the same advantages as the on-chip miniature X-ray source provided in FIG. 19, which will not be repeated herein for the sake of brevity.

It should be noted that, in the present disclosure, the sequence of steps S211, S212 and S213 is not limited.

The foregoing embodiments are only preferred embodiments of the present disclosure. The preferred embodiments are used to disclose the present disclosure, rather than limiting the present disclosure. With the method and technical content disclosed above, those skilled in the art may make some variations and improvements to the technical solutions of the present disclosure, or make some equivalent variations on the embodiments without departing from the scope of technical solutions of the present disclosure. All simple modifications, equivalent variations and improvements made based on the technical essence of the present disclosure without departing from the content of the technical solutions of the present disclosure fall within the protection scope of the technical solutions of the present disclosure.

The invention claimed is:

1. An on-chip miniature X-ray source, comprising:

an on-chip miniature electron source;

a first insulating spacer provided on an electron-emitting side of the on-chip miniature electron source, wherein the first insulating spacer has a cavity structure; and an anode provided on the first insulating spacer, wherein a closed vacuum cavity is formed between the on-chip miniature electron source and the anode, wherein the on-chip miniature electron source comprises:

a substrate;

a resistive-switching material film layer covering a surface of the substrate; and at least one electrode pair provided on the resistive-switching material film layer, wherein the at least one electrode pair comprises a first electrode and a second electrode, and there is a gap between the first electrode and the second electrode, wherein a tunnel junction is formed within a region of the resistive-switching material film layer under the gap, wherein the substrate is made of a material with thermal conductivity, the resistive-switching material film layer is provided with at least one through hole connecting with the substrate, and at least one electrode of the at least one electrode pair is in contact with and connected to the substrate via the at least one through hole.

2. The on-chip miniature X-ray source according to claim 1, wherein the at least one electrode pair comprises a plurality of interdigital electrode pairs.

3. The on-chip miniature X-ray source according to claim 1, further comprising a first heat dissipation component provided on the anode.

4. The on-chip miniature X-ray source according to claim 3, further comprising a second heat dissipation component provided under the substrate.

5. The on-chip miniature X-ray source according to claim 1, wherein the first insulating spacer has a hollow cavity structure.

6. The on-chip miniature X-ray source according to claim 1, wherein the first insulating spacer has a cavity structure provided with a top cover, and a conductive plug is provided on the top cover, the anode is located under the top cover, and the anode is electrically connected to an electrode on the first insulating spacer through the conductive plug.

7. The on-chip miniature X-ray source according to claim 1, wherein the X-ray source further comprises:

a hollow focusing electrode provided between the first insulating spacer and the on-chip miniature electron source, wherein a second insulating spacer is provided on a surface of the hollow focusing electrode close to the on-chip miniature electron source, and the second insulating spacer has a hollow cavity structure, wherein the second insulating spacer is attached to the on-chip miniature electron source.

8. The on-chip miniature X-ray source according to claim 1, wherein a suction component is provided in the closed vacuum cavity, and the suction component is used to absorb gas in the closed vacuum cavity to adjust or maintain a vacuum in the closed vacuum cavity.

9. The on-chip miniature X-ray source according to claim 1, wherein the anode comprises a target layer and a support layer for supporting the target layer, the target layer is located at a side close to electron bombardment, and the support layer is located at a side away from the electron bombardment.

10. The on-chip miniature X-ray source according to claim 9, wherein the target layer is made of a heavy metal material, and the support layer is made of copper or aluminum.

11. The on-chip miniature X-ray source according to claim 1, wherein the anode has a thickness of 0.1 microns to 1000 microns.

12. A method for manufacturing an on-chip miniature X-ray source, comprising:

preparing an on-chip miniature electron source;

preparing an anode, wherein a first insulating spacer is provided on a surface of the anode, and the first insulating spacer has a cavity structure; and bonding the first insulating spacer to an electron-emitting side of the on-chip miniature electron source, so that a closed vacuum cavity is formed between the on-chip miniature electron source and the anode, wherein the preparing an on-chip miniature electron source comprises:

providing a substrate;

forming a resistive-switching material film layer covering a surface of the substrate;

forming at least one electrode pair on the resistive-switching material film layer, wherein the at least one electrode pair comprises a first electrode and a second electrode, and there is a gap between the first electrode and the second electrode; and before or after the bonding the first insulating spacer to an electron-emitting side of the on-chip miniature electron source, so that a closed vacuum cavity is formed between the on-chip miniature electron source and the anode, the preparing the on-chip miniature electron source further comprises:

controlling the resistive-switching material film layer under the gap to be softly broken down and exhibit a resistive-switching characteristic, so as to form a tunnel junction within a region of the resistive-switching material film layer under the gap, wherein the substrate has thermal conductivity, and after the forming a resistive-switching material film layer and before the forming at least one electrode pair, the method further comprises:

forming at least one through hole connecting with the substrate on the resistive-switching material film layer, wherein at least one electrode of the at least one electrode pair is in contact with and connected to the substrate via the at least one through hole.

13. The method according to claim 12, wherein before bonding the first insulating spacer to the on-chip miniature electron source, the method further comprises:

preparing a hollow focusing electrode, wherein a second insulating spacer is provided on a surface of the hollow focusing electrode, and the second insulating spacer has a hollow cavity structure;

before bonding the first insulating spacer to the on-chip miniature electron source, the method further comprises:

bonding the second insulating spacer to the electron-emitting side of the on-chip miniature electron source; and the bonding the first insulating spacer to the on-chip miniature electron source comprises:

bonding the first insulating spacer to a side of the hollow focusing electrode away from the second insulating spacer.

14. The method according to claim 12, wherein before the bonding the first insulating spacer to an electron-emitting side of the on-chip miniature electron source, so that a closed vacuum cavity is formed between the on-chip miniature electron source and the anode, the method further comprises:

disposing a suction component into the closed vacuum cavity to be formed, wherein the suction component is used to absorb gas in the closed vacuum cavity, to adjust or maintain a vacuum in the closed vacuum cavity.

15. The method according to claim 12, further comprising:

forming a first heat dissipation component on the anode.

* * * * *